US006347623B1

(12) United States Patent
Kownacki et al.

(10) Patent No.: US 6,347,623 B1
(45) Date of Patent: Feb. 19, 2002

(54) TOY PROJECTILE LAUNCHING ASSEMBLY

(75) Inventors: Charles D. Kownacki, Erie, PA (US); Jeffery G. Rehkemper, Chicago, IL (US)

(73) Assignee: Spin Master Toys, Toronto (CA)

( * ) Notice: Subject to any disclaimer, the term of this patent is extended or adjusted under 35 U.S.C. 154(b) by 0 days.

(21) Appl. No.: 09/481,513

(22) Filed: Jan. 12, 2000

(51) Int. Cl.[7] ..... F41B 11/00
(52) U.S. Cl. ..... 124/56
(58) Field of Search ..... 124/56, 57; 446/180

(56) References Cited

U.S. PATENT DOCUMENTS

| | | | | | |
|---|---|---|---|---|---|
| 2,733,699 | A | * | 2/1956 | Krinsky | 124/69 |
| 3,046,694 | A | * | 7/1962 | Holderer | 446/212 |
| 3,740,896 | A | | 6/1973 | Glass et al. | |
| 3,937,191 | A | * | 2/1976 | Green | 124/57 |
| 3,962,818 | A | * | 6/1976 | Pippin, Jr. et al. | 446/212 |
| 4,223,472 | A | | 9/1980 | Fekete et al. | |
| 4,591,071 | A | | 5/1986 | Johnson | |
| 5,032,100 | A | | 7/1991 | Goldfarb | |
| 5,074,437 | A | | 12/1991 | D'Andrade et al. | |
| 5,188,557 | A | | 2/1993 | Brown | |
| 5,197,452 | A | | 3/1993 | Johnson et al. | |
| 5,381,778 | A | | 1/1995 | D'Andrade et al. | |
| 5,415,153 | A | * | 5/1995 | Johnson et al. | 124/63 |
| 5,433,646 | A | | 7/1995 | Tarng | |
| 5,496,025 | A | * | 3/1996 | Phillips et al. | 124/56 |
| 5,515,837 | A | | 5/1996 | Nin et al. | |
| 5,538,453 | A | | 7/1996 | Johnson | |
| 5,549,497 | A | | 8/1996 | Johnson et al. | |
| 5,553,598 | A | | 9/1996 | Johnson et al. | |
| RE35,412 | E | | 12/1996 | Johnson et al. | |
| 5,653,216 | A | | 8/1997 | Johnson | |
| 5,799,827 | A | | 9/1998 | D'Andrade | |
| 5,819,717 | A | | 10/1998 | Johnson et al. | |
| 5,826,750 | A | | 10/1998 | Johnson | |
| 5,850,941 | A | | 12/1998 | Johnson et al. | |
| 6,203,397 | B1 | * | 3/2001 | Applewhite et al. | 446/475 |

* cited by examiner

*Primary Examiner*—Charles T. Jordan
*Assistant Examiner*—Jordan Lofdahl
(74) *Attorney, Agent, or Firm*—Roylance, Abrams, Berdo & Goodman, LLP

(57) ABSTRACT

A toy projectile launching assembly for safely permitting the projectile to be launched only in predetermined directions and only under at predetermined pressure levels through the use of redundant safety mechanisms and pressure relief systems. The launching assembly has a fluid system enabling multiple launches without the need for replacing a fluid such as water in the launch assembly. The launch assembly provides water and pressurized air for a projectile such as a rocket to launch from a self-contained, portable launching assembly, which is easy to operate.

62 Claims, 26 Drawing Sheets

TOY PROJECTILE LAUNCHING ASSEMBLY

FIELD OF THE INVENTION

The invention relates generally to a toy rocket launcher assembly for launching a projectile. More specifically, the invention relates to a toy launching assembly capable of launching a projectile using water and pressurized air and enabling the projectile to be launched repeatedly without refilling the launching assembly with water, while providing multiple safety mechanisms to prevent the launching of the projectile at an unsafe launch angle and to prevent the system from being pressurized beyond safe limits.

BACKGROUND OF THE INVENTION

The use of toy rockets launched through the use of water and pressurized air is generally known in the art. However, the prior art assemblies typically are very dangerous in that they can be pointed and launched in any direction and at any inclination. Thus, children could use the prior art in a dangerous manner by launching the prior art rockets directly at each other along a horizontal firing line. Additionally, many prior art assemblies are also dangerous in that the rockets and the entire launching assemblies can be pressurized beyond a safe level since there exists no safety mechanisms regulating the pressure within the rocket or within the launching assembly. Further, these prior art rockets must be used close to a water source since the rockets must be refilled at the water source after each launching, thus limiting the versatility and mobility of the assembly and limiting the area in which the rocket can be repeatedly be launched.

Some examples of prior art launching assemblies are disclosed in the following U.S. Pat. No. : 3,740,896 to Glass et al.; U.S. Pat. No. 4,223,472 to Fekete et al.; U.S. Pat. No. 5,188,557 to Brown; U.S. Pat. No. 5,197,452 to Johnson et al.; U.S. Pat. No. 5,381,778 to D'Andrade et al.; U.S. Pat. No. 5,415,153 to Johnson et al; U.S. Pat. No. 5,433,646 to Tarng; 5,538,453 to Johnson; U.S. Pat. No. 5,515,837 to Nin et al.; U.S. Pat. No. 5,538,453 to Johnson; U.S. Pat. No. 5,553,598 to Johnson et al.; U.S. Pat. No. 5,653,216 to Johnson; and U.S. Pat. No. 5,819,717 to Johnson et al.

Thus, there is a continuing need to provide more versatile and safer toy projectile launching assemblies, especially launching assemblies employing both water and air. This invention addresses these needs in the art along with the other needs which will become apparent to those skilled in the art from this disclosure.

SUMMARY OF THE INVENTION

One object of the invention is to provide an improved toy projecting launching assembly.

Another object of the invention is to provide a toy projectile launching assembly with safety mechanisms to prohibit launching of the rocket if tilted greater than a predetermined angle from the vertical direction.

Another object of the invention is to provide a toy projectile launching assembly having redundant safety mechanisms to ensure that the projectile does not launch until the rocket is positioned in a predetermined launching orientation.

Another object of the invention is to provide a toy projectile launching assembly having pressure relief mechanisms to ensure the fluid pressure within the assembly does not exceed a predetermined limit.

Yet another object of the invention is to provide a toy projectile launching assembly capable of launching the projectile multiple times without refilling the launching assembly with liquid.

Yet another object of the invention is to provide a toy projectile launching assembly having an efficient projectile release mechanism.

A further object of the invention is to provide an improved, modular projectile.

The foregoing objects are basically obtained by providing a toy projectile launching assembly, comprising a fluid storage assembly including a storage tank; a pumping mechanism including a pump; a projectile; a valve assembly in fluid communication with the storage assembly, the pumping mechanism, and the projectile, the valve assembly including a valve having a first position in which the storage assembly, the pumping mechanism, and the projectile being in fluid communication and a second position in which said pumping mechanism and the projectile being in fluid conmmunication; and a launch platform assembly including a catch removably coupled to the projectile and a trigger coupled to the catch.

The foregoing objects are also obtained by providing a toy projectile launching assembly, comprising a fluid storage assembly including a storage tank containing water; a pumping mechanism including an air pump; a projectile having a water and air chamber; a valve assembly in fluid communication with the storage assembly, the pumping mechanism, and the projectile, the valve assembly including a valve having a first position in which the storage assembly, the pumping mechanism, and the projectile being in fluid communication and a second position in which the pumping mechanism and the water and air chamber being in fluid communication; a launch platform assembly including a catch removably coupled to the projectile and a trigger coupled to the catch; a pressure indicating assembly including a gauge fluidly coupled to the valve assembly, the pumping mechanism, and the projectile; and a first launch-prohibiting mechanism coupled to the trigger and including a trigger lock movable between a trigger-stopping position and a trigger firing position, the launch platform assembly having a second launch-prohibiting mechanism including a retaining element movable between a first position in which the retaining element engages the projectile and a second position in which the retaining element does not engage the projectile.

The foregoing objects are also obtained by providing a method of launching a toy projectile, comprising the steps of providing a launching assembly having a fluid storage assembly including a storage tank for receiving a first fluid, a pumping mechanism including a pump for pumping a second fluid, a projectile, a valve assembly in fluid communication with the storage assembly, the pumping mechanism, and the projectile, the valve assembly including a valve having a first position in which the storage assembly, the pumping mechanism, and the projectile being in fluid communication and a second position in which the pumping mechanism and the projectile being in fluid communication, and a launch platform assembly including a catch removably coupled to the projectile and a trigger coupled to the catch; positioning the valve to the first position; actuating the pump to force the second fluid into the storage tank and to, in turn, force the first fluid into the projectile; repositioning the valve to the second position; actuating the pump to force the second fluid into the projectile; and moving the trigger to disengage the catch from the projectile and permit the projectile to launch.

The foregoing objects are also obtained by providing a toy projectile launching assembly, comprising a liquid storage assembly including a storage tank having a liquid receiving opening, an intake port, and an output port; a gas pumping mechanism including a pump having an intake port and an output port; and a projectile having an intake port, the output port of the air pump being coupled by a first conduit and in fluid communication with the intake port of the storage tank, the output port of the storage tank being coupled by a second conduit and in fluid communication with the intake port of the projectile, and the output port of the air pump being coupled by a third conduit and in fluid communication with the intake port of the projectile.

The foregoing objects are also obtained by providing a method of launching a toy projectile, comprising the steps of providing a launching assembly having a storage tank, a projectile, a pump, and a valve coupled together to form a single, integral assembly with the tank, the projectile and the pump being in fluid communication with the valve; filling the storage tank with liquid; transferring liquid from the storage tank into the projectile; switching the valve from a first position to a second position; pumping gas into the projectile; holding the entire assembly in a firing position; and launching the projectile.

The foregoing objects are also obtained by providing a method of launching a toy projectile, comprising the steps of providing a launching assembly having a storage tank, a first projectile and a launch platform forming a single, integral assembly, with the tank, the first projectile and the pump being in fluid communication; filling the storage tank with the entire amount of a quantity of liquid; transferring a first portion of the quantity of liquid from the storage tank into the first projectile; pumping gas into the first projectile; launching the first projectile; inserting a second projectile into the launch platform; transferring a second portion of the quantity of liquid from the storage tank into the second projectile; pumping gas into the second projectile; and launching the second projectile.

The foregoing objects are also obtained by providing a toy projectile launching assembly, comprising a liquid storage assembly including a storage tank having a liquid receiving opening, an intake port, and an output port, the liquid receiving port having a cap removably coupled to the receiving port for permitting or denying access to the storage tank, the cap having a pressure relief device fluidly coupled to the storage tank; a gas pumping mechanism including a pump having an output port; and a projectile having an intake port, the output port of the air pump being coupled by a first conduit and in fluid communication with the intake port of the storage tank, the output port of the storage tank being coupled by a second conduit and in fluid communication with the intake port of the projectile.

The foregoing objects are also obtained by providing a toy projectile launching assembly, comprising a projectile having a base; and a launch platform assembly including a catch removably coupled to the base and a trigger assembly coupled to the catch, the catch having a first shoulder, a second shoulder, and a biasing element, each of the first and second shoulders being coupled to the trigger assembly and movable between a locking position and a launching position, the biasing element biasing the first and second shoulders in the locking position.

The foregoing objects are also obtained by providing a toy projectile launching assembly, comprising a projectile having a base with a first securing element and a second securing element and a firing axis extending centrally through said base and extending along the initial intended flight path of said projectile as the projectile is positioned to launch from the remainder of the launching assembly; and a launch platform assembly including a catch removably coupled to the first securing element and a trigger assembly coupled to the catch, the catch being movable between a locking position and a launching position, the launch platform assembly further including first and second locking pins removably coupled to the second securing element, each of the first and second locking pins being coupled to a launch platform and being pivotable between an engaged position in contact with the second securing element and a disengaged positioned spaced from the second securing element, at least one of the first and second locking pins being in the engaged position when the firing axis is inclined relative a vertical axis and each of the first and second locking pins being in the disengaged position when the firing axis is parallel to the vertical axis.

The foregoing objects are also obtained by providing a toy projectile launching assembly, comprising an air pump; a projectile having a pressure chamber for receiving air from the pump; a first conduit coupled to the pump and to the pressure chamber with the pump and the pressure chamber being in fluid communication with each other; and a launch platform positioned between the projectile and the first conduit and coupling the projectile and the first conduit together, the launch platform having a pressure relief device biasing the projectile and the first conduit together.

The foregoing objects are also obtained by providing a toy projectile launching assembly, comprising a projectile having a base; and a launch platform assembly including a catch removably coupled to the base; a trigger assembly coupled to the catch; and a trigger-locking mechanism connected to the trigger and having a upper housing, a lower housing slidably coupled to the upper housing, and a stop coupled to the upper housing and moveable between a lock position in which the stop engages the lower housing and prohibits movement of the trigger and a fire position in which the stop permits movement of the trigger.

The foregoing objects are also obtained by providing a toy projectile, comprising a storage tank having an upper threaded portion, a lower threaded portion and a middle portion; cushioning member having a threaded element engaged with the upper threaded portion of the tank; and a nozzle for locking the projectile into a launching platform and for receiving pressurized fluid, the nozzle having a threaded element engaged with the lower threaded portion of the tank.

The foregoing objects are also obtained by providing a method of launching a toy projectile, comprising the steps of providing a launching assembly having a projectile and a launch platform having first and second launch preventing mechanisms; orienting the launching assembly to a first position to launch the projectile; prohibiting the launching of the projectile through the engagement of the first launch preventing mechanism; prohibiting the launching of the projectile through the engagement of the second launch preventing mechanism; reorienting the launching assembly to a predetermined, second position to launch the projectile; and launching the projectile.

Other objects, advantages, and salient features of the invention will become apparent from the following detailed description, which, taken in conjunction with the annexed drawings, discloses preferred embodiments of the invention.

BRIEF DESCRIPTION OF THE DRAWINGS

Referring now to the attached drawings which form a part of this disclosure.

DETAILED DESCRIPTION OF THE INVENTION

Figure 1:
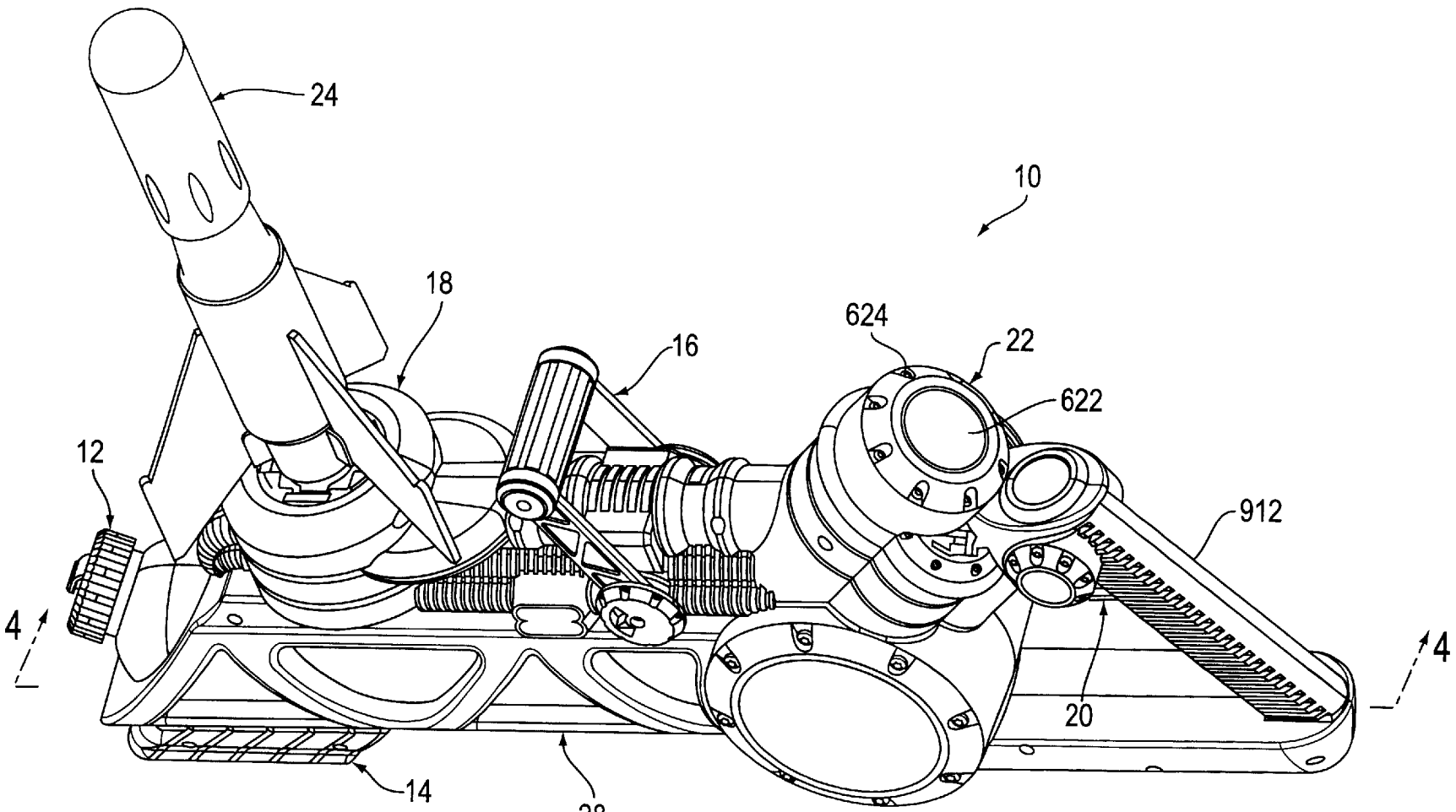
FIG. 1 is a top, front, side perspective view of the launching assembly in accordance with the present invention.
Figure 2:
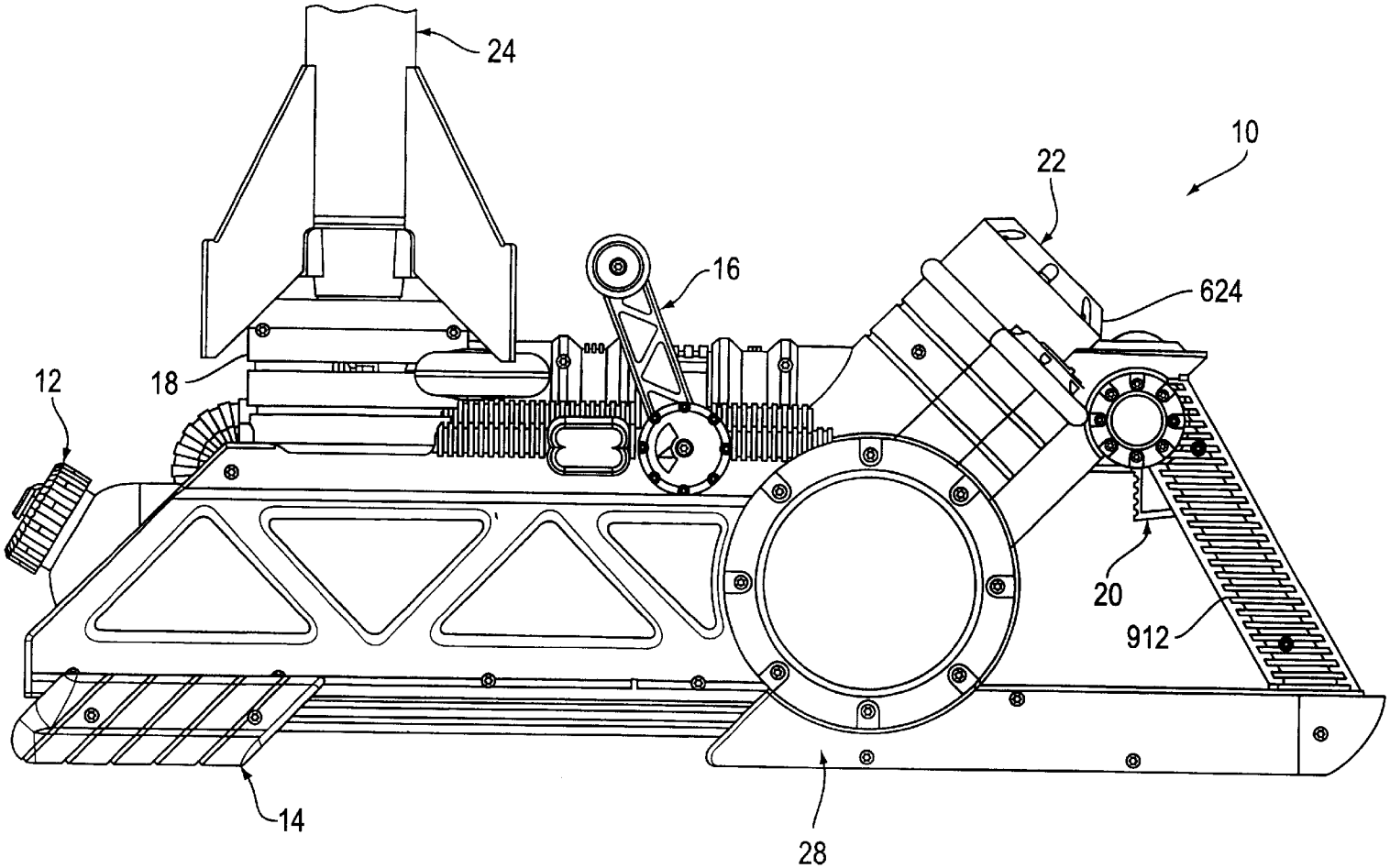
FIG. 2 is a partial, side elevational view of the launching assembly of the present invention.
Figure 3:
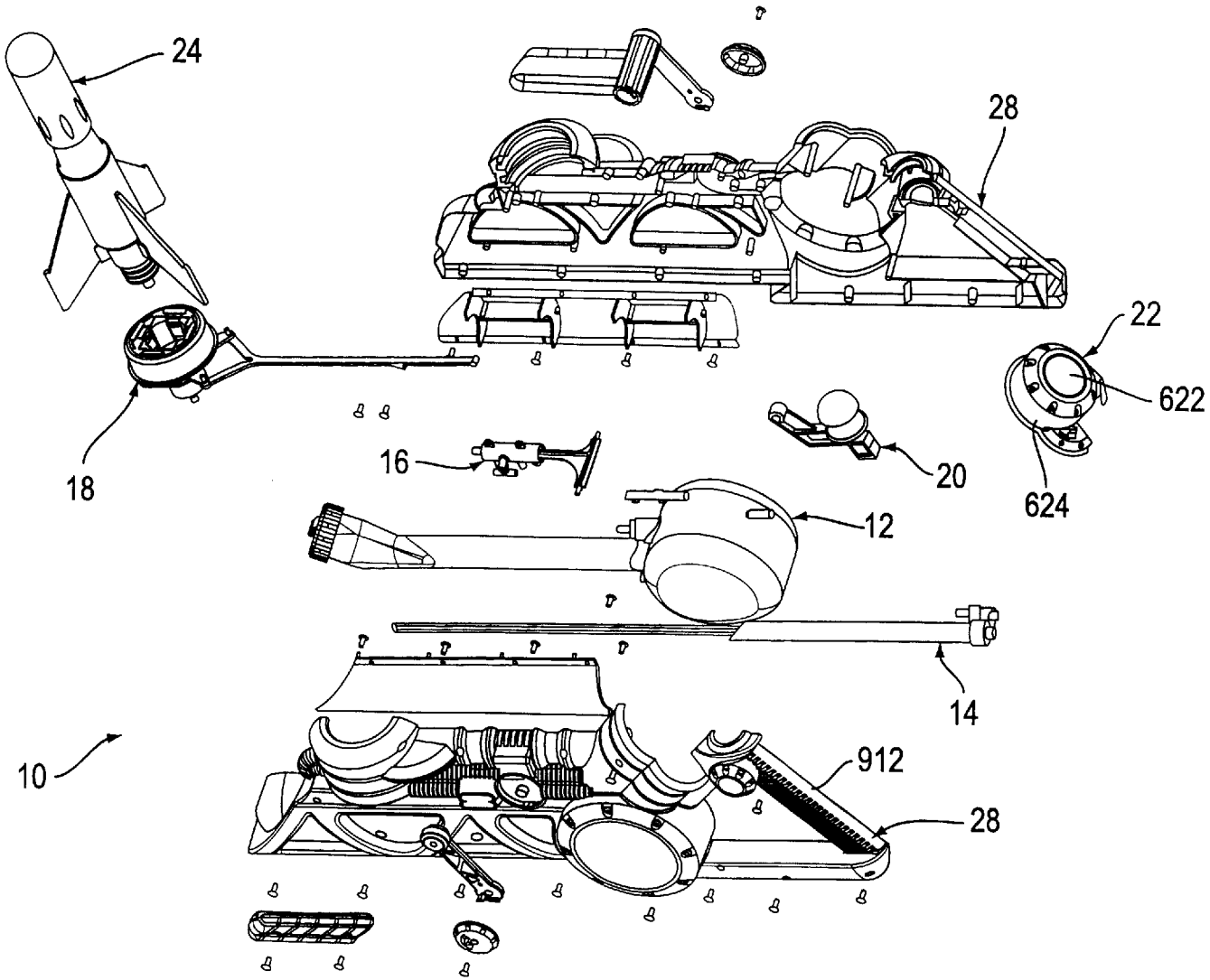
FIG. 3 is an exploded, top, front, side perspective view of the launching assembly in accordance with the present invention.
Figure 4:
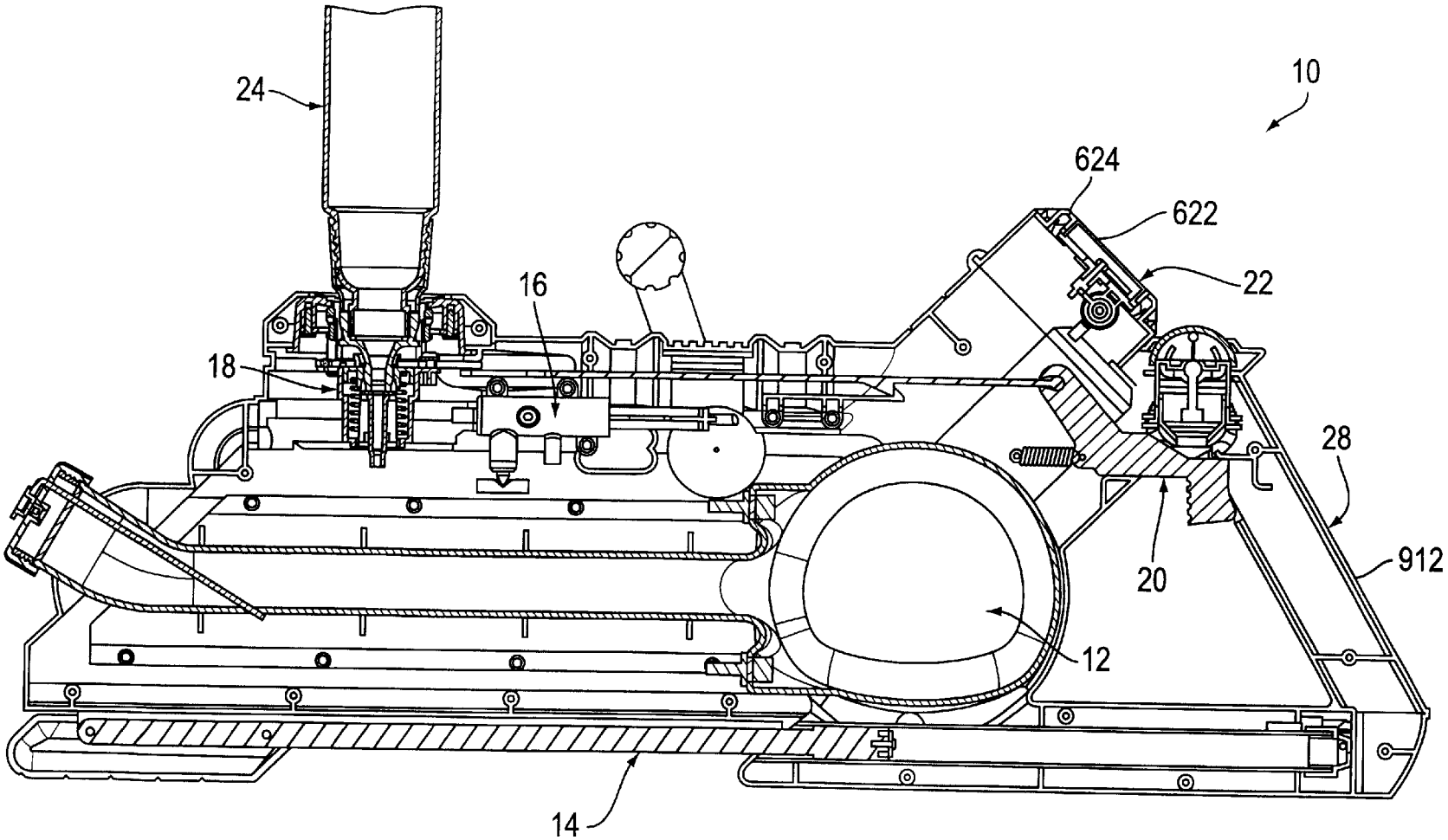
FIG. 4 is a side, cross-sectional view of the launching assembly in accordance with the present invention and taken along line 4—4 in FIG. 1.

FIGS. 1–4 illustrate a launching assembly 10 in accordance with the present invention. The launching assembly includes a fluid storage tank 12 for storing water, a pumping mechanism 14 for pumping air, a valve assembly 16 for controlling the flow or water and air, a launch platform 18 for holding and releasing a projectile or rocket 24, a trigger assembly 20 for activating the launch platform 18, a pressure indicating assembly 22 for displaying the pressure in the rocket 24, a conduit assembly 26 for transporting the fluids, and a housing 28 for enclosing the assembly 10 as a hand-held, portable unit. The launching assembly 10 provides a device for launching toy projectiles that is capable of being held in the hands of a user and easily transported due to its generally lightweight since most elements can be formed of plastic.

Figure 5:
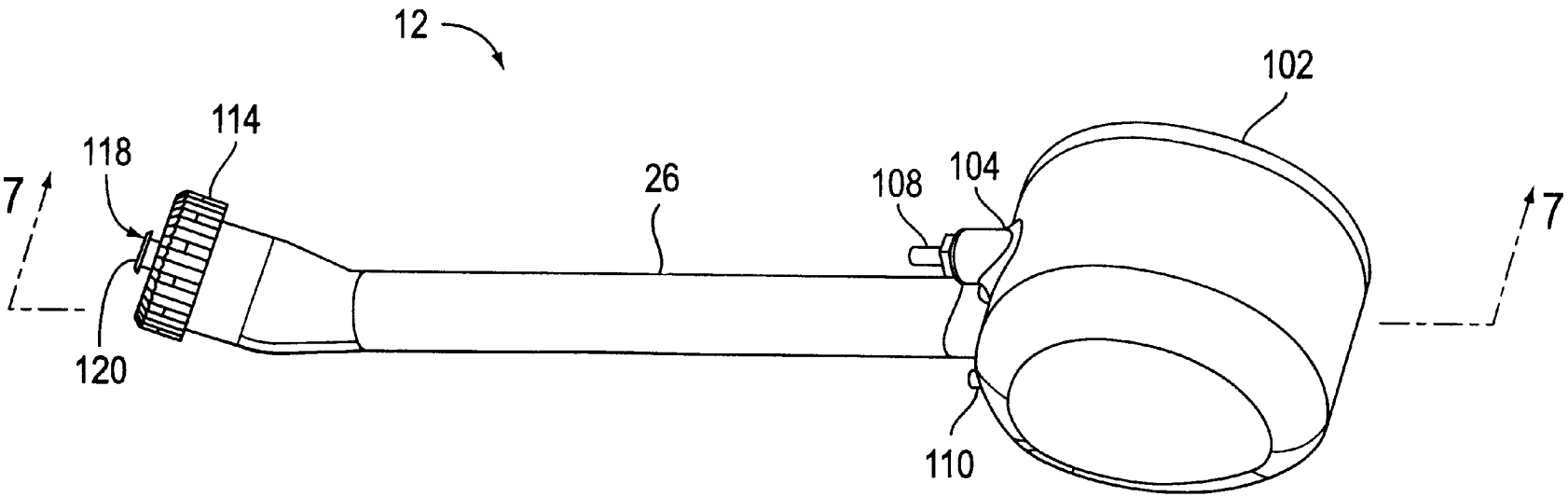
FIG. 5 is a top, front, side perspective view of a fluid storage tank in accordance with the present invention.
Figure 6:
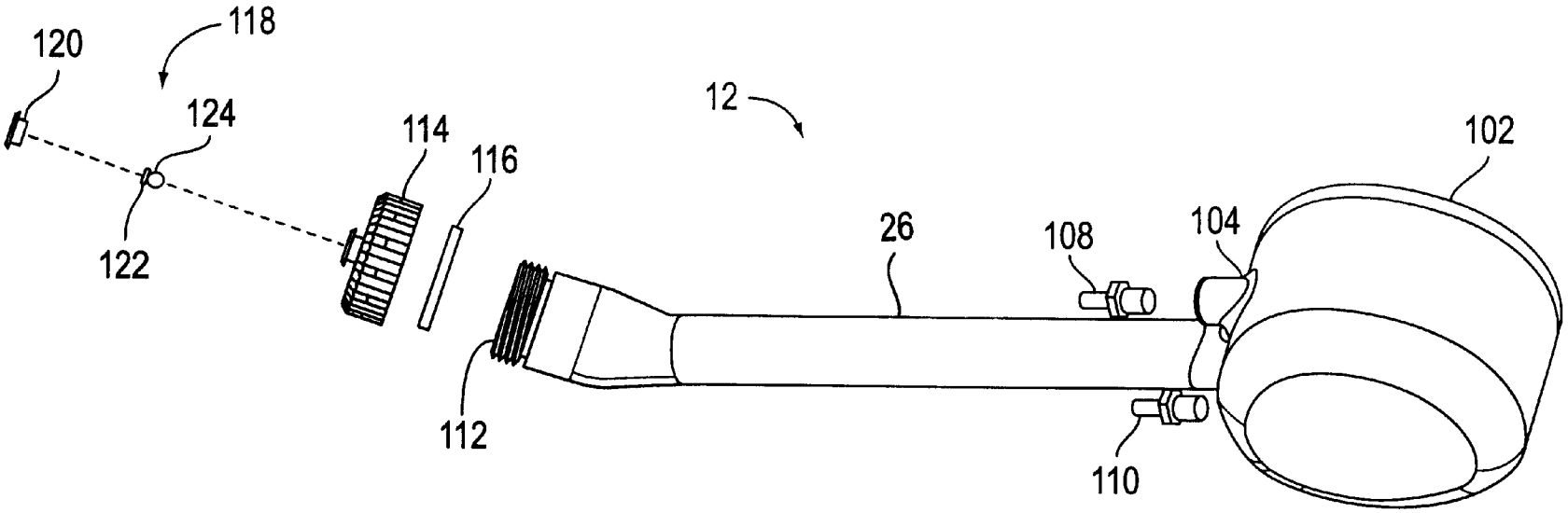
FIG. 6 is an exploded, top, front, side perspective view of the fluid storage tank in accordance with the present invention.
Figure 7:
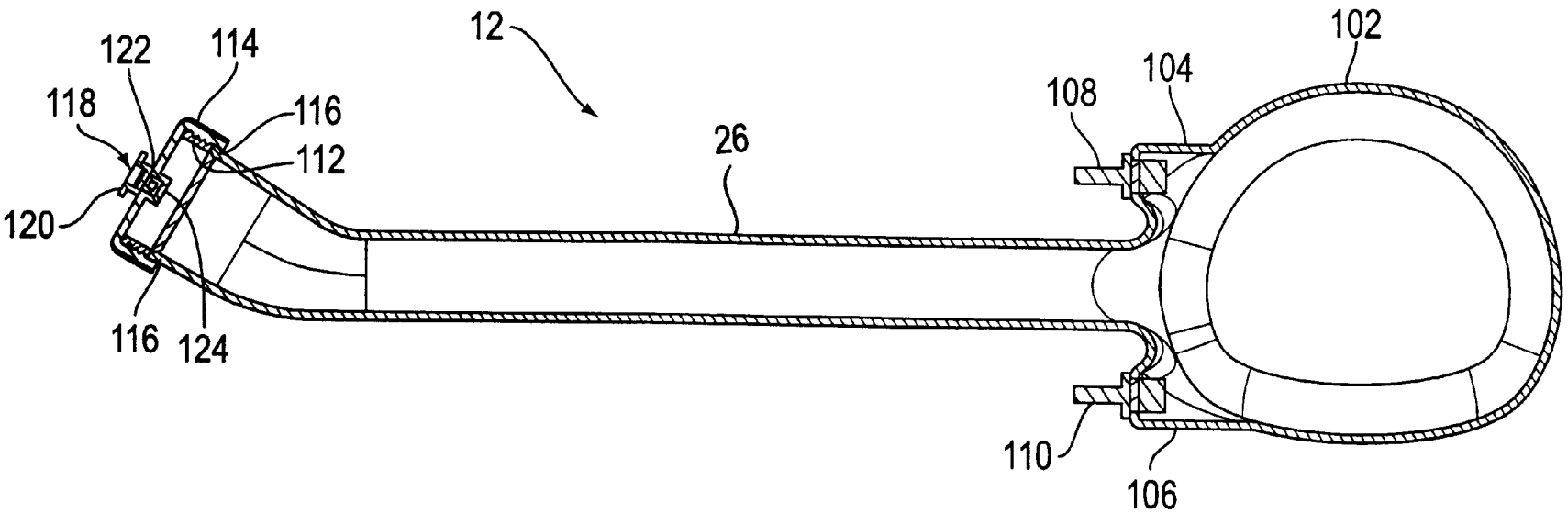
FIG. 7 is a side, cross-sectional view of the fluid storage tank in accordance with the present invention taken along line 7—7 and FIG. 5.

As seen in FIGS. 5–7, fluid storage tank or water storage container 12 is filled with a fluid for ultimately being positioned within rocket 24. Preferably the fluid is water, but other appropriate fluids can be used. Tank 12 has a bottle 102 for receiving and storing water and an intake port 104 and an output port 106 with connectors 108 and 110, respectively for coupling the tank 12 to the conduit assembly 26. Tank 12 also has a main opening 112 for receiving water from a water supply. The main opening can be closed by a threaded cap 114, which has a gasket 116 to create a leak-proof seal. As a safety device, cap 114 has a pressure relief device 118 located therein formed by a cover 120 securing a spring 122 and ball 124 to form a one-way valve.

Tank 12 receives water from an outside water source by removing cap 114 and pouring water through opening 112 until bottle 102 is filled. Then cap 114 is threaded back on to bottle 102 until securely fastened. The pressure relief device 118 ensures that when bottle 102 is pressurized as discussed later, the pressure within bottle 102 will be released through pressure release relief device 118 when the pressure exceeds a predetermined limit. Although the pressure relief device can be formed to relieve pressure at any predetermined pressure level, preferably the pressure relief device is formed to release pressure if the pressure within bottle 102 increases above 35 psi. Of course, tank 12 is preferably designed to withstand pressures much higher than 35 psi.

As will be discussed below, intake port 104 is fluidly coupled with conduit assembly 26 to received pressurized air into bottle 102. The pressurized air pressurizes bottle 102 and forces water out the output port 106 and through a portion of conduit assembly 26 to rocket 24. Thus, output port 106 is fluidly coupled to rocket 24.

Bottle 102, intake port 104 and output port 106 are preferably integrally formed as a one-piece unitary member from plastic material. Although it should be understood that the material used can vary depending on the requirements of the user and can be materials other than plastic. However, using plastic permits the bottle 102 to be blow molded and to retain is lightweight.

Figure 8:
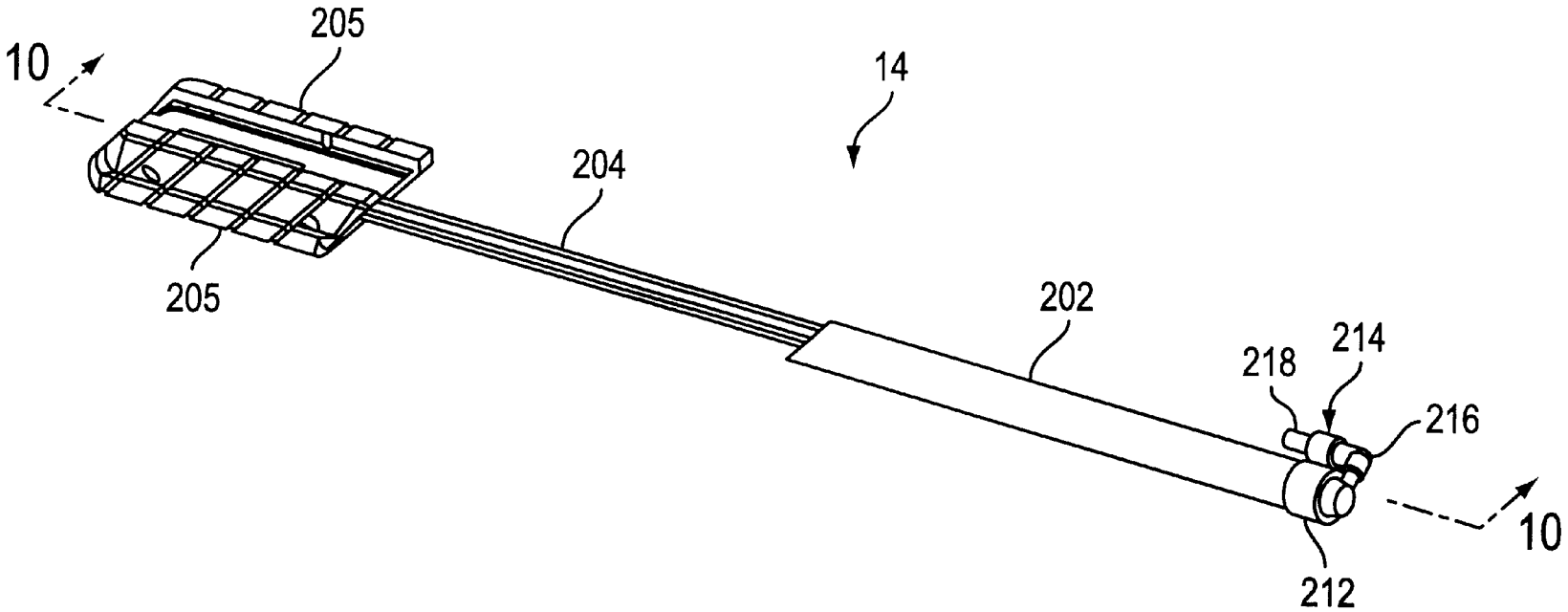
FIG. 8 is a top, front, side perspective view of a pumping mechanism in accordance with the present invention.
Figure 9:
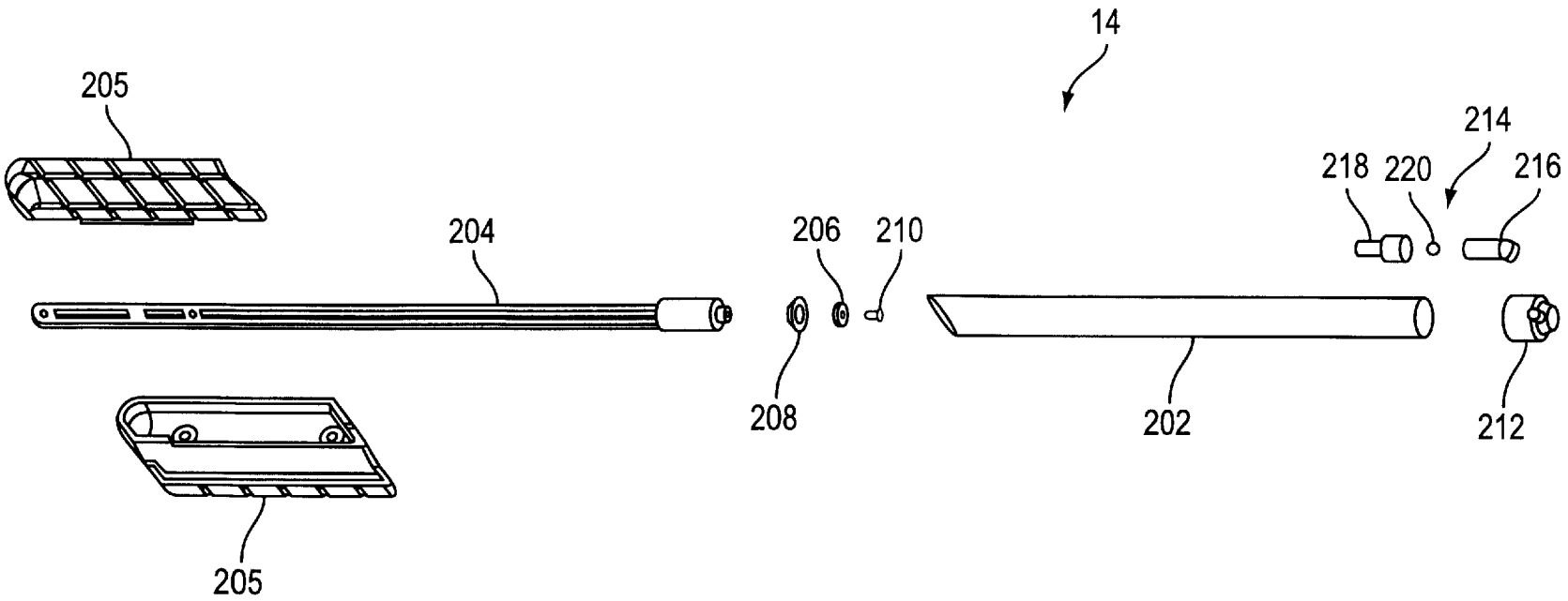
FIG. 9 is a exploded, top, front, side perspective view of the pumping mechanism in accordance with the present invention.
Figure 10:
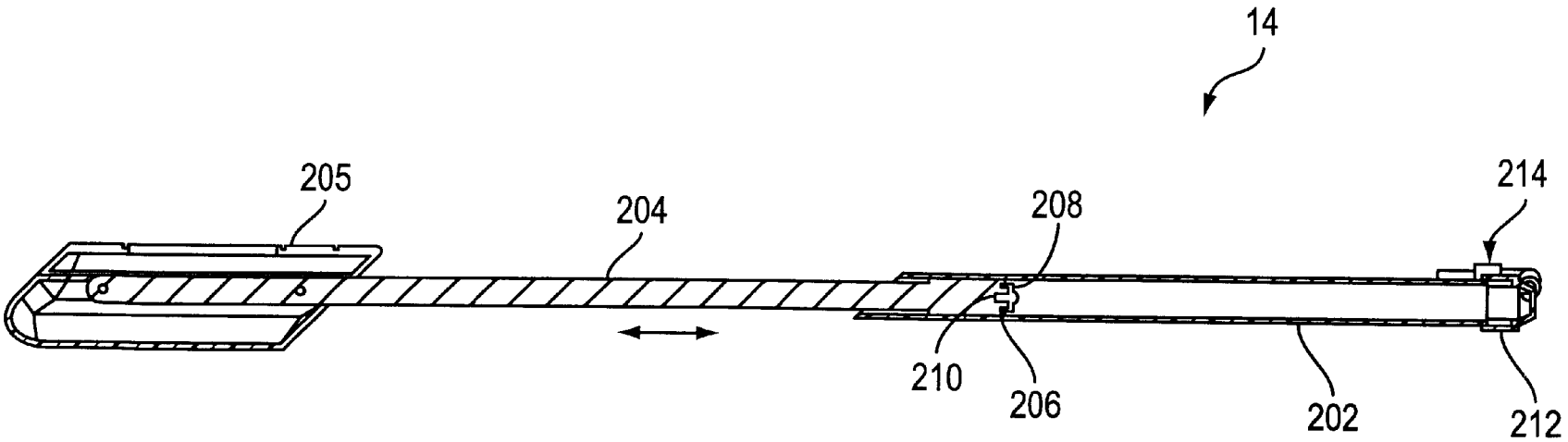
FIG. 10 is a side, cross-sectional view of the pumping mechanism in accordance with the present invention taken along line 10—10 in FIG. 8.
Figure 11:
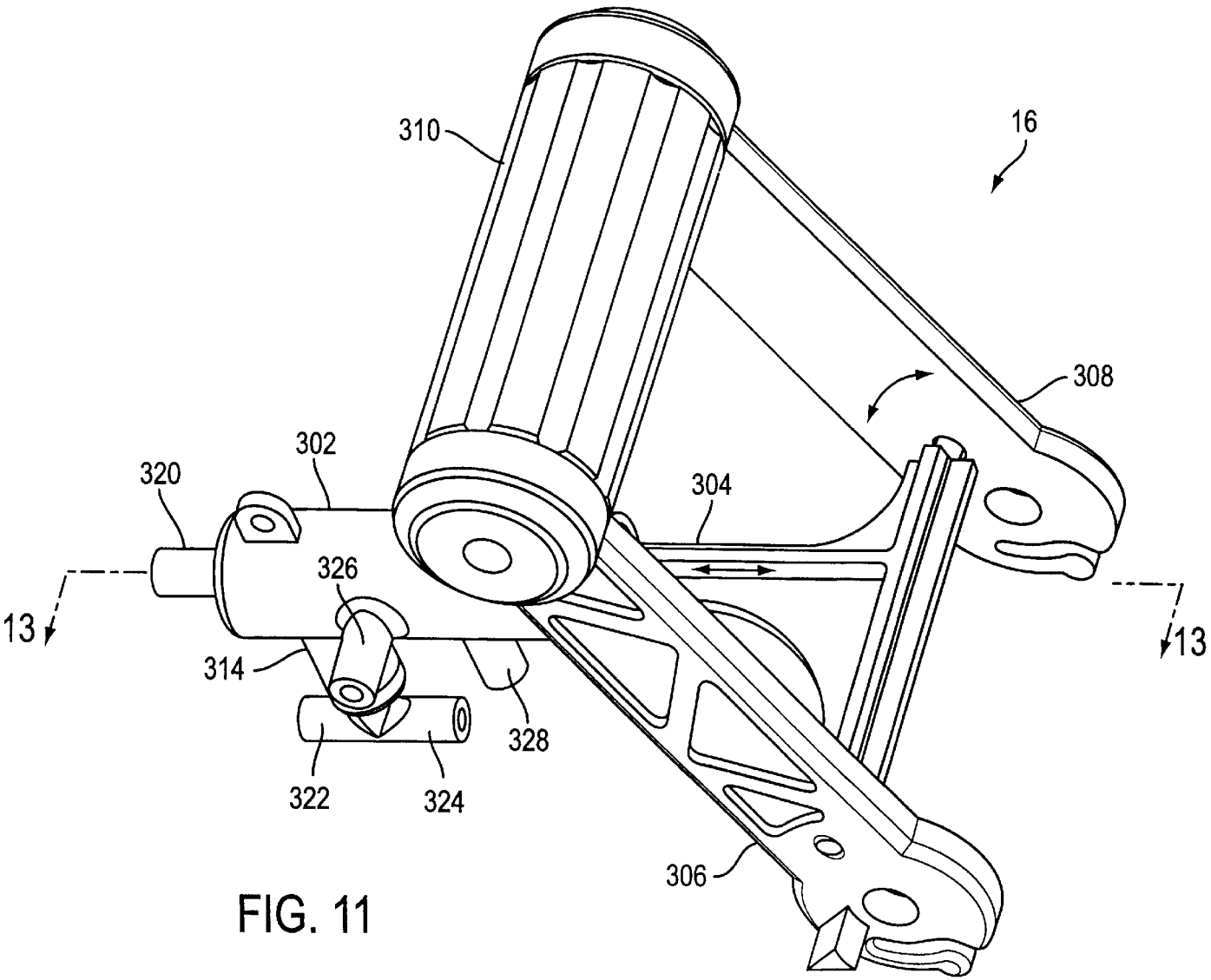
FIG. 11 is a top, front, side perspective view of a valve assembly in accordance with the present invention.
Figure 12:
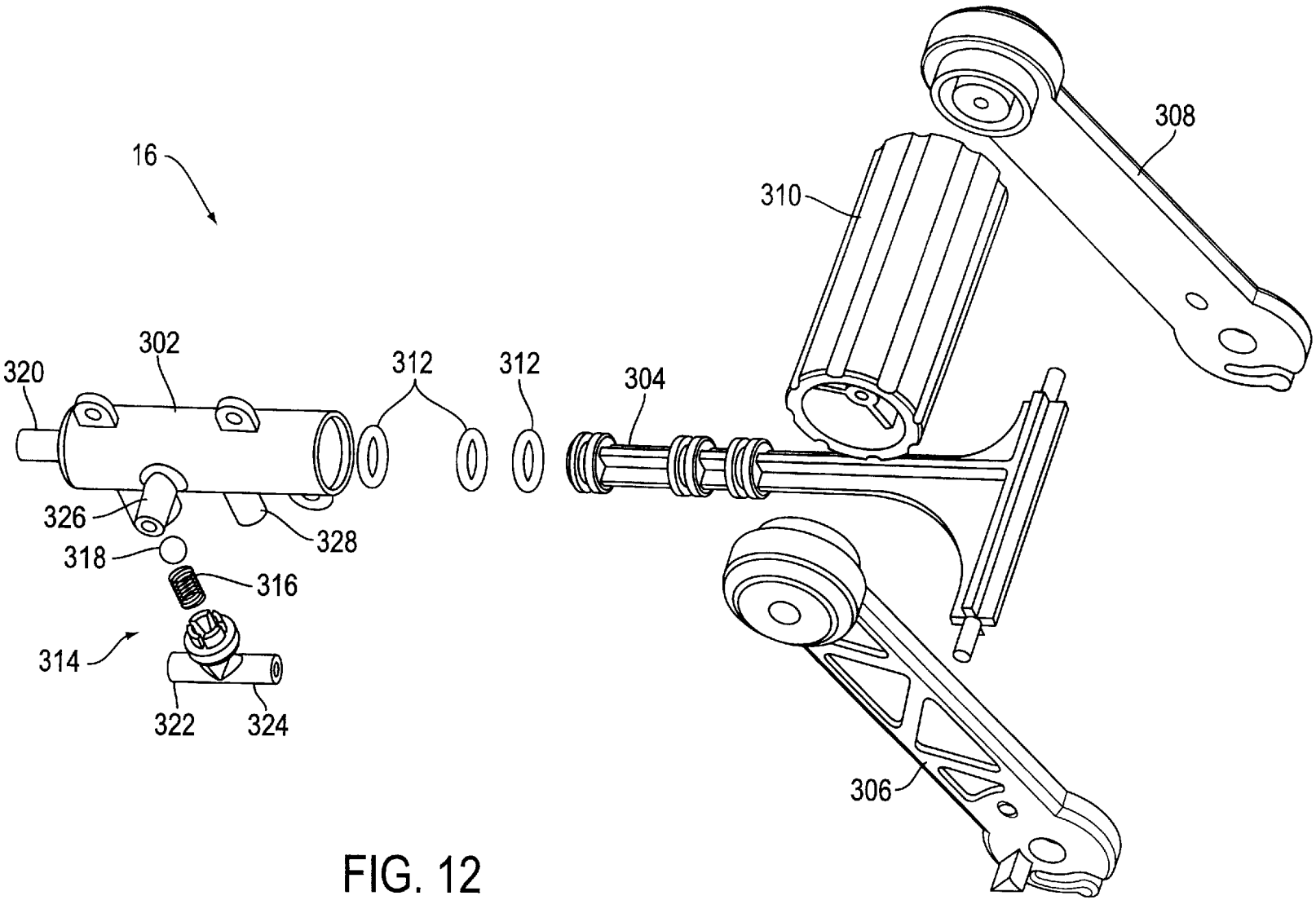
FIG. 12 is an exploded, top, front, side perspective view of the valve assembly in accordance with the present invention.

FIGS. 8–10 illustrate a pumping mechanism 14 for supplying pressurized air to the water storage tank 12 and to the rocket 24. The pumping mechanism or pump 14 includes a cylinder 202 for receiving a rod 204 with handles 205 coupled to the end of the rod 204 that does not enter cylinder 202. The end of rod 204 within cylinder 202 has a seal 206, which is secured to the rod 204 by a screw 210 and a cylinder attachment 212. The cylinder attachment permits the seal 206 to move between two positions so that air can pass through the seal when the rod 204 is pulled away from the cylinder 202 and then become air-impermeable as rod 204 is pushed into cylinder 202, thus, creating the pressure within the conduit assembly 26. The closed end of the cylinder 202 has a one-way check valve 214 comprising an inlet 216, an outlet 218 and a ball 220 in order to prevent the pressurized air from escaping from the conduit assembly 26.

The pump 14 is arranged at the bottom of housing 280 and positioned such that the cylinder 202 resides within the housing 28 while the handles 205 reside outside the housing 208. The handles 205 can then slide along the housing 208 so that the rod 204 can be slid back and forth along the housing 28. When pumped, the rod 204 forces the seal 206 and seal washer 208 into cylinder 202 forcing air through valve 214 and into the launch assembly as discussed below. Repeated pumping by pumping of the rod 204 into the cylinder 202 increases the pressure within the launching assembly 10 due to the check valve 214, since air can only be forced into the system and is not released through check valve 214 but only through other mechanisms in the launching assembly as discussed below. Preferably, the pumping mechanism 14 is made from plastic material except for the seal and the screw. As known in the art, adhesives can be used to secure the plastic elements of the pumping mechanism 14 together without the use of mechanical fasteners.

FIGS. 11–14 illustrate the valve assembly 16, which enables the pressurized air from pump 14 to be selectively directed to either the water storage tank 12 or directly to the rocket 24. Valve assembly 16 includes a housing 302 and a piston 304 movable within housing 302 by movement of left and right-arm levers 306 and 308, which are connected to a handle 310. The piston has o-rings 312 to form sealed areas within the housing 302 and a one-way valve 314 is coupled to the housing and includes a spring 316 and a ball 318. The valve assembly 16 also has ports 320, 322, 324, 326 and 328.

Valve assembly 16 can take many forms and can be formed as plurality of valves with the ultimate goal of permitting pressurized air to selectively proceed to the water storage container 12 or to the rocket 24. Preferably, valve assembly 16 is formed of a plastic housing 302 and piston 304 with rubber o-rings 312, although other appropriate materials can be used as desired.

Figure 13:
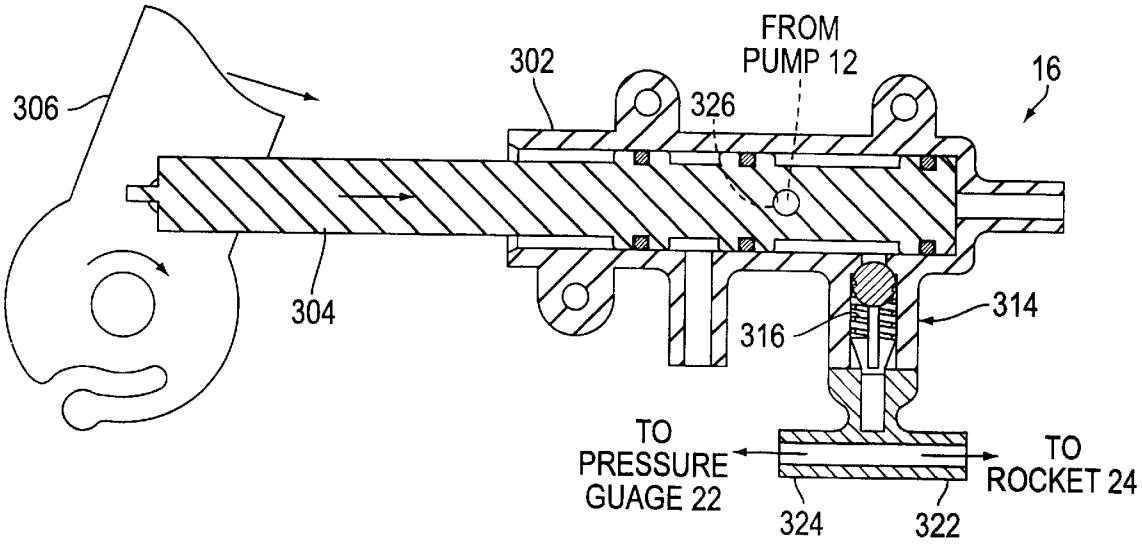
FIG. 13 is a right side cross sectional view of the valve assembly in accordance with the present invention, taken along line 13—13 in FIG. 11 illustrating the valve assembly in a second position, or a position for permitting pressurized air to proceed from the pumping mechanism to the projectile.
Figure 14:
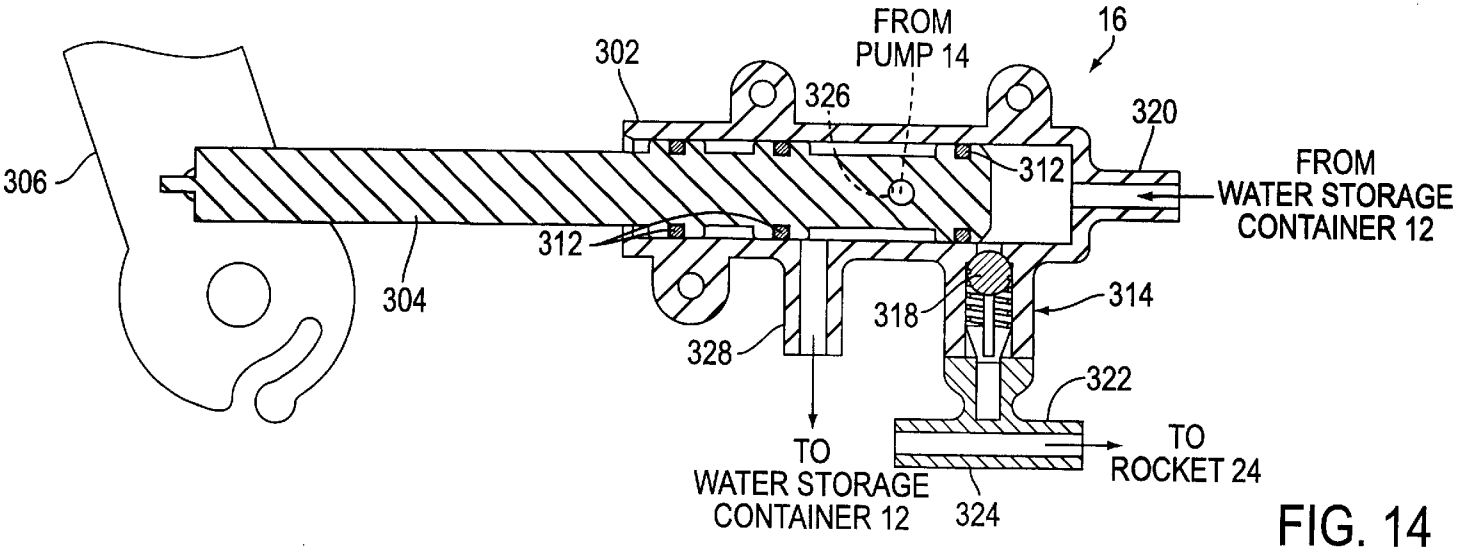
FIG. 14 is a right side, cross-sectional view of the valve assembly in accordance with the present invention, similar to FIG. 13, but illustrating the valve assembly in a first position permitting water to be pumped from the storage tank to the projectile.
Figure 15:
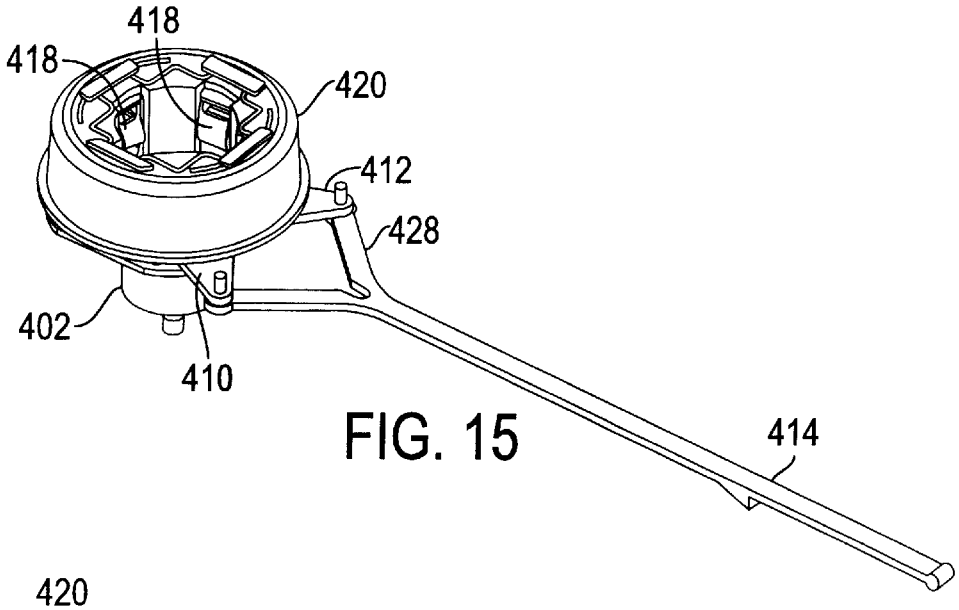
FIG. 15 is a top, front, side perspective view of a launch platform in accordance with the present invention.
Figure 16:
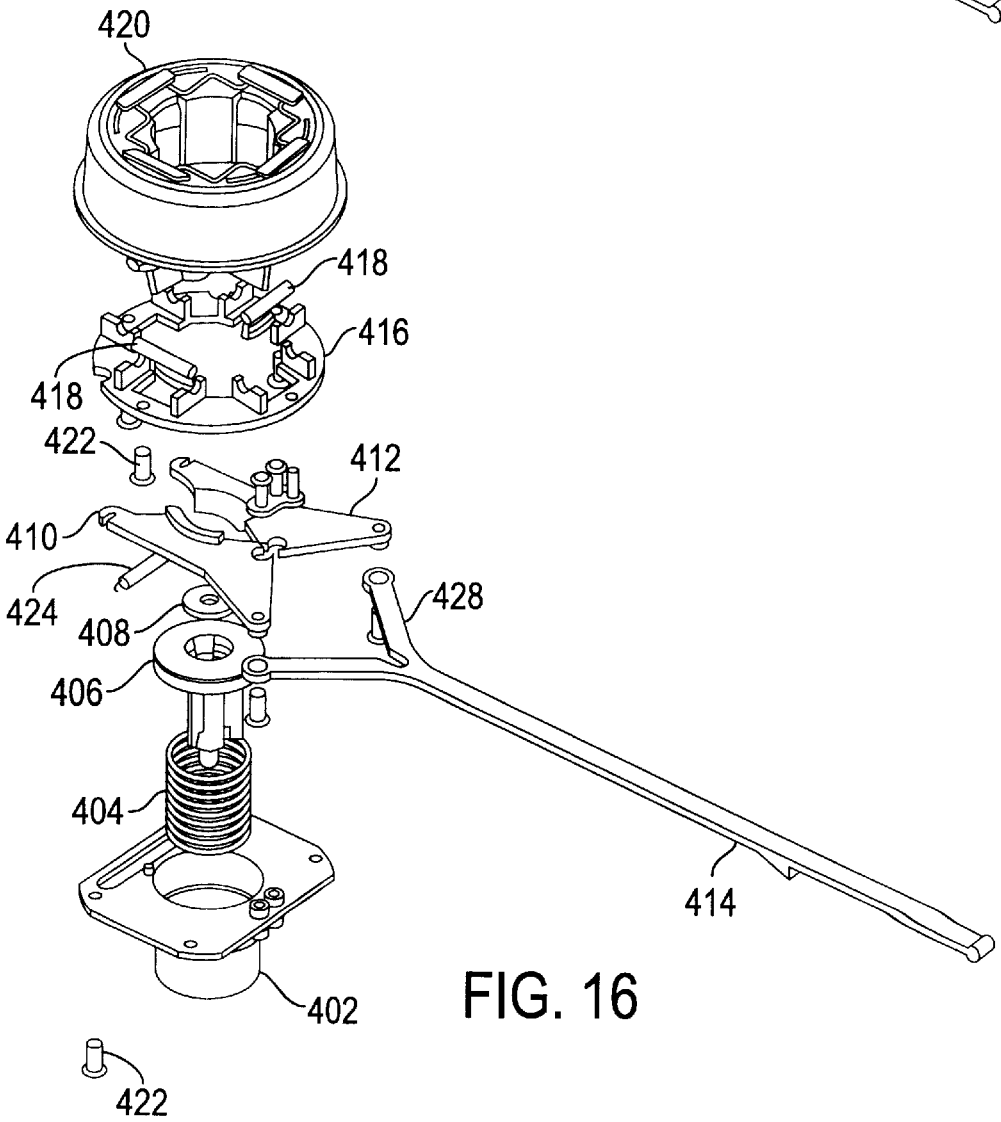
FIG. 16 is an exploded, top, front, side perspective view of the launch platform in accordance with the present invention.
Figure 17:
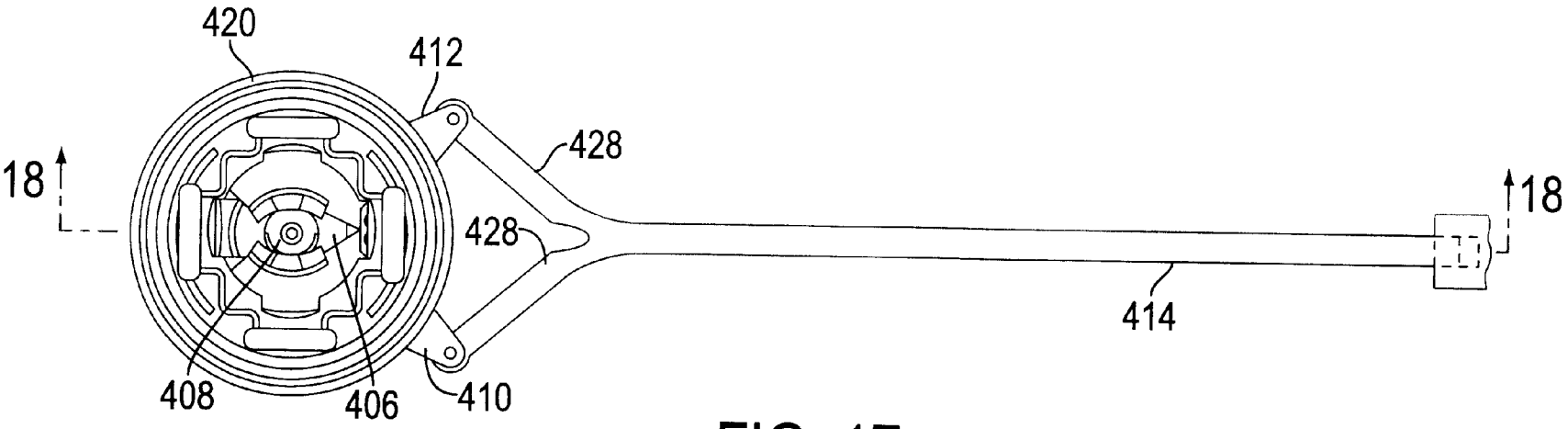
FIG. 17 is a top view of the launch platform in accordance with the present invention with the launch platform being in the closed, non-launching position.
Figure 18:
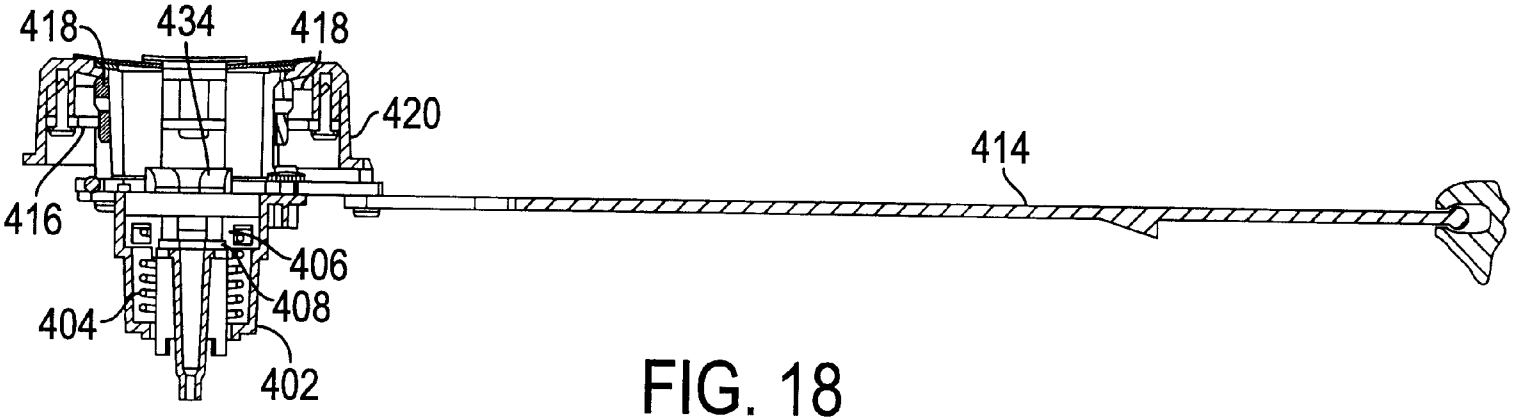
FIG. 18 is a side, cross-sectional view of the launch platform in accordance with a present invention taken along lines 18—18 in FIG. 17.

As illustrated in FIGS. 13 and 14 valve assembly 16 operates in one of two positions. In a first position, illustrated in FIG. 14, the levers 306 and 308 are pivoted to a rearward position, toward the trigger assembly 20. Since the levers 306 and 308, are coupled to piston 304, the piston is moved out, in a direction away from housing 302, or in the left direction as illustrated in FIG. 14. The arrangement of piston 304 and housing 302 permits air from pump 14 to pass through port 326 and be directed to port 328 and then to water storage tank 12. Additionally, water is permitted to travel from storage container 12, through port 320, through housing 302 and port 322, and then to rocket 24.

Levers 306 and 308 can then be pivoted to the second position as shown in FIG. 13, in which the levers 306 and 308 are pivoted forward, towards the rocket 24, to move the piston 304 further into housing 302. In the position shown in FIG. 13, the piston 304 permits air from pump 12 to proceed through port 326 and housing 302 to rocket 24 through port 322 and to pressure gage 22 through port 324. Since one-way valve 314 is positioned upstream of ports 322 and 324, the pressure formed downstream of valve 314 can be held constant regardless of the position of piston 304.

FIGS. 15–22 illustrate the launch platform mechanism 18 in accordance with the invention. The launch platform mechanism 18 is multifaceted in that it provides the mechanism to hold the rocket 24 in place prior to firing and the mechanism for releasing the rocket 24 for launching. Additionally, launch platform mechanism 18 provides safety mechanisms that prevent the launching of the rocket 24 if the rocket 24 is tiled beyond an unsafe or undesired predetermined angle, and prevents the rocket 24 from being pressurized beyond an unsafe or undesirable predetermined limit.

The launch platform mechanism 18 includes pressure relief device formed by a retainer 402 for holding a spring 404, a seal housing 406 for housing a seal 408.

The rocket 24 is held and released by a left catch or shoulder 410, a right catch or shoulder 412, and a linkage 414 coupled to each of the catches 410 and 412. The antitilting mechanism includes a pin retainer 416 supporting four locking pins 418, a cover 420, and screws 422 for securing the cover 420 to the seal housing 406.

Preferably, all of the elements of the launch platform mechanism 18 are formed from plastic material except for the springs 404, the seal 408 and the screws 422. However, launch platform mechanism 18 can be manufactured from any appropriate material desired.

Figure 19:
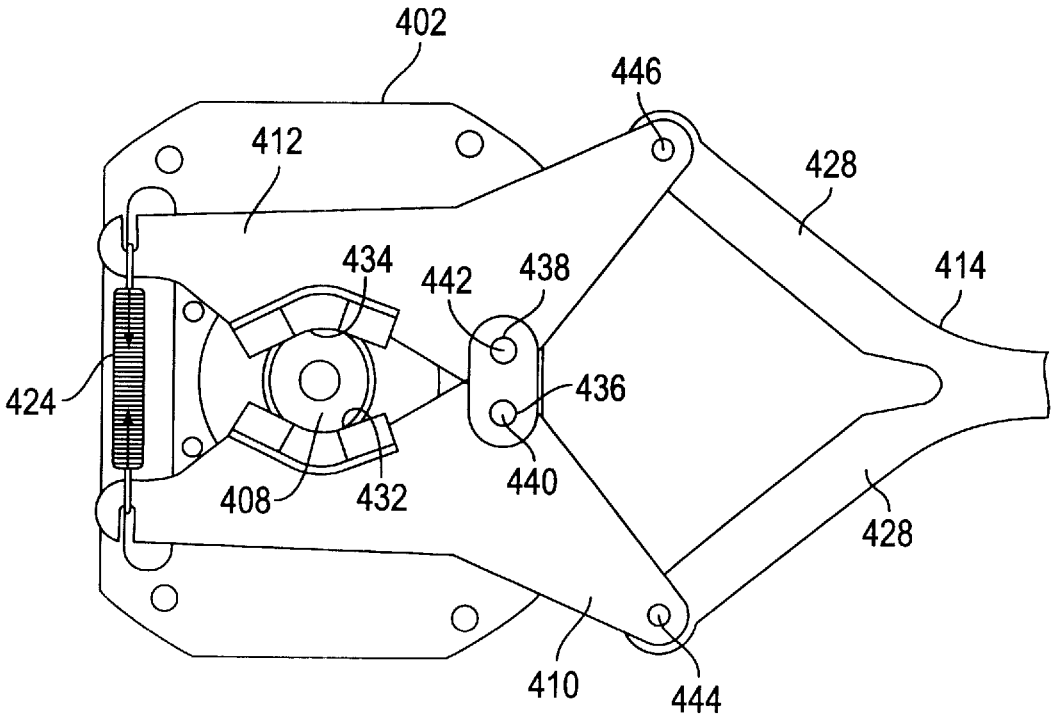
FIG. 19 is an enlarged, top view of the launch platform in accordance with the present invention with the cover removed to show the catches in the closed, non-launching position.

In order to retain rocket 24 in position within launch platform mechanism 18 prior to launching, launch platform mechanism 18 relies upon left catch 410 and right catch 420 to be positioned around the bottom nozzle 716 of rocket 24. As seen in FIG. 19, left and right catches 410 and 412 are biased by a tension spring 424 to a predetermined biasing level and a closed position. Left catch 410 includes a gripping portion 432 for gripping the rocket 24, a pivot pin 436 for coupling the left catch 410 to the retainer 402 and for permitting left catch 410 to pivot thereabout. Thus, left catch 410 can pivot about a pivot axis 440, which extends perpendicular to the drawing illustrated in FIG. 19. Left catch 410 also has a pin 444 which couples left catch 410 to an arm of linkage 414. Linkage 414 is coupled to the trigger assembly 20 as discussed below. Left catch 410 also has a slot 448 for connecting with tension spring 424. Tension spring 424 biases left catch in the closed position as illustrated in FIG. 19 in order to bias the gripping portion 432 against the nozzle 716 of rocket 24 to maintain the rocket 24 in a fixed position within the launch platform mechanism 18. Since right catch 412 is substantially identical to left catch 410, right catch 412 will not be described in detail.

Figure 20:
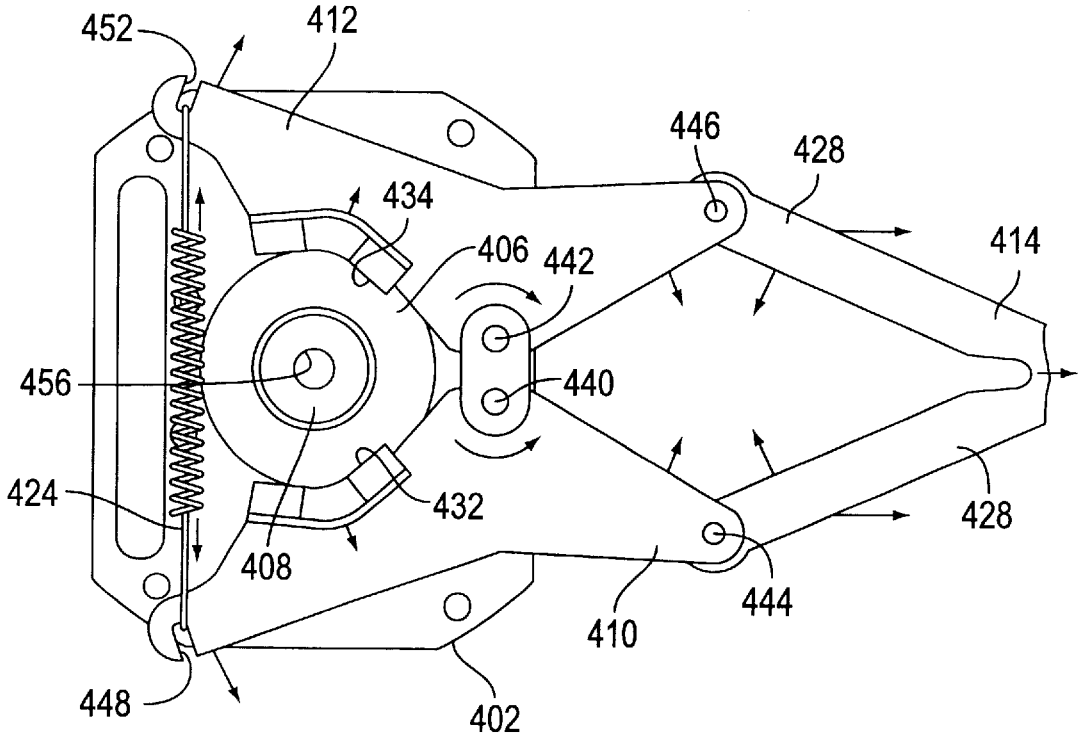
FIG. 20 is a top view of the launch platform in accordance with the present invention with the cover removed illustrating the catches pivoted to the launching position.

When it is desired to launch the rocket 24, trigger 502 is moved rearwardly as discussed below, thus moving the linkage 414 rearwardly, or to the right as illustrated in FIG. 20, causing the arms 428 of linkage 414 to move towards each other as they move away from the pivot pins 436 and 438. This movement by linkage 414 results in left and right catches 410 and 412 rotating about pivot axes 440 and 442 respectively, or about pivot pins 436 and 438, respectively. This pivoting of the left and right catches 410 and 412 moves the gripping portions 432 and 434 away from rocket 24 to create an opening between gripping portions 432 and 434 that is now greater than the outer-most diameter of the rocket 24 at its attachment point to launch platform mechanism 18. Thus, rocket 24 is now permitted to launch and leave launch platform mechanism 18 due to the release of pressure previously built up within rocket 24. Upon the release of the force applied by the finger to the trigger 502 for moving linkage 414, tension spring 424 acts to move left and right catches 410 and 412 back to the closed position illustrated in FIG. 19, thus closing the gap between gripping portions 432 and 434.

Therefore, when rocket 24 is forced into the area between gripping portions 432 and 434 enough pressure must be exerted down by the rocket 24 to separate gripping portions 432 and 434 from each other and, thus. pivot catches 410 and 412 about pivot axis 440 and 442, respectfully. The pivoting of catches 410 and 412 must be sufficient to permit the rocket nozzle 716 to be inserted into a position between gripping portions 432 and 434. Thus, in the rest position illustrated in FIG. 19, the gripping portions 432 and 434 are spaced a distance smaller than the smallest outer diameter of the bottom of nozzle 716 of the rocket 24 which makes contacts with launch platform mechanism 18. The tension spring 424 then creates tension on each of the left and right catches 410 and 412 to provide sufficient pressure on rocket 24 by gripping portions 432 and 434 to maintain rocket 24 in the fixed position in the launch platform mechanism 18 as illustrated in FIG. 1. The launch of rocket 24 is accomplished by pulling trigger 502 and, thus, moving linkage 414 as discussed above.

The launch platform mechanism 18 is capable of regulating the maximum amount of pressure within rocket 24 by incorporating its own pressure relief device formed by spring 404, seal housing 406 and seal 408, all received within retainer 402.

Figure 21:
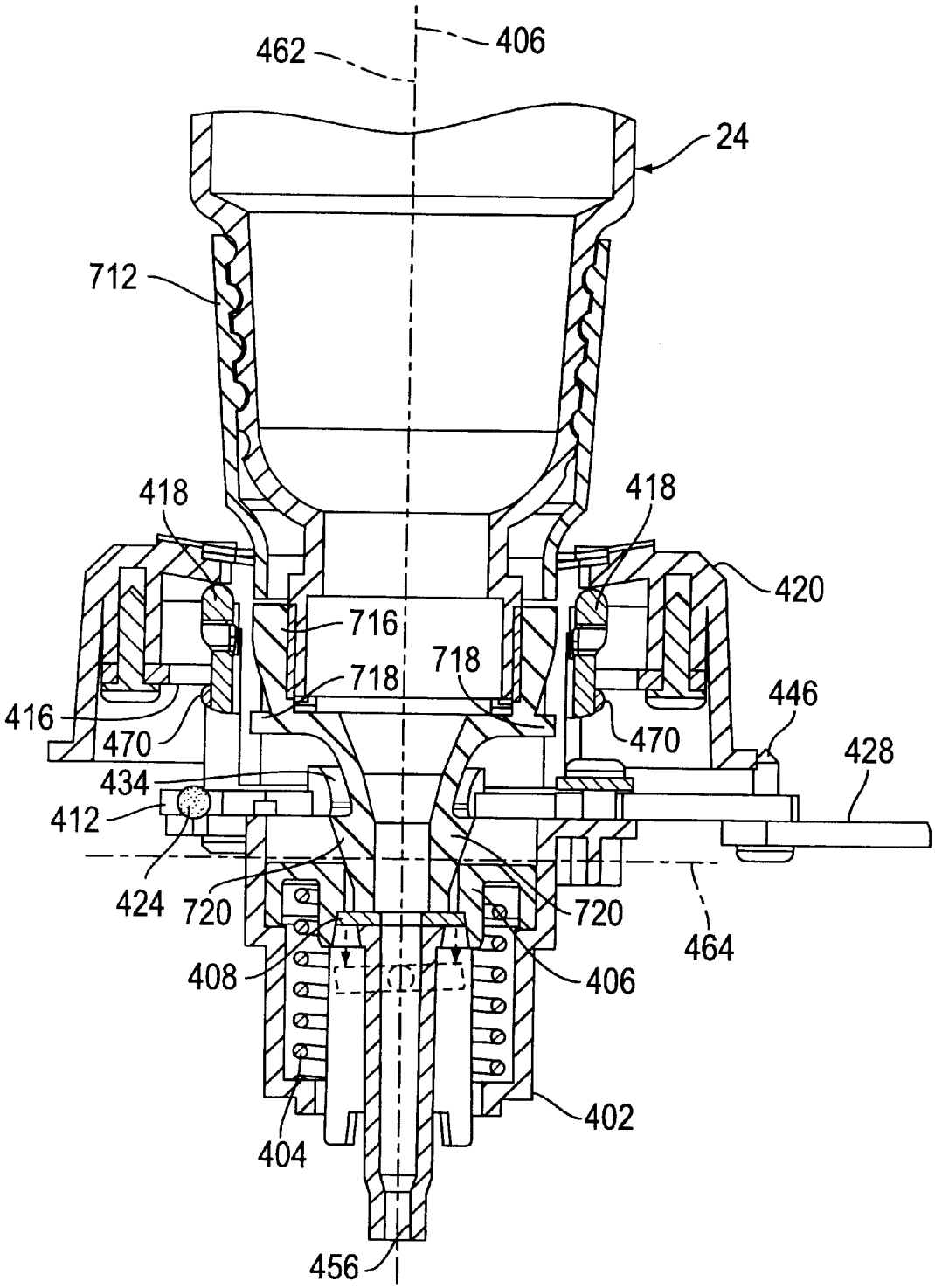
FIG. 21 is an exploded, cross-sectional view of the launching assembly in accordance with the present invention similar to FIG. 4 but illustrating only the rocket attached to the launch platform mechanism and illustrating the rocket and launch platform mechanism in a launching position.

As seen in FIG. 21, rocket 24 is engaged within launch platform mechanism 18 in a non-firing position. Thus, gripping portions 432 and 434 are biased against nozzle 17, specifically against securing element ridge 720. Additionally, a seal is formed between nozzle 716 and seal 408. Then, water and air can be inserted into rocket 24 through opening 456 in seal housing 406. Opening 456 is thus fluidly coupled through conduits assembly 26 to air pump 14 and water storage container 12.

Compression spring 404 is positioned between the top of seal housing 406 and the bottom of retainer 402. Spring 404 is preferably a metal spring having predetermined characteristics such that the spring 404 will force seal housing 206 and, thus, seal 408 upwardly against the bottom of nozzle 716 to create a pressure-tight seal. This pressure-tight seal permits rocket 24 to be pressurized as desired. The pressure within rocket 24 creates a force pressing downwardly against seal 408 and seal housing 406 and against the upward force of compression spring 404. If the pressure within rocket 24 stays within desired, predetermined limits, a seal is maintained between the rocket 24 and the launch platform mechanism 18.

If the pressure within rocket 24 exceeds the predetermined limit, as set by the strength of the spring 404, the spring 404 will compress due to the force applied against the seal 408 and the seal housing 406 from the rocket 24. As a result, the seal housing 406 and seal 408 will move downwardly with the spring 404. The displacement of seal 408 is illustrated in dashed lines in FIG. 21.

The movement of seal housing 406 and seal 408 downwardly with the compression of spring 404 separates seal 408 from rocket 24 and permits water and air from within rocket 24 to be released to an area outside rocket 24 and outside of seal housing 406. Once the pressure has been lowered to within the acceptable limit within rocket 24 by the release of the water and air, the lowered pressure will result in a smaller force against the seal housing 406 and seal 48 and movement by the seal 48 against the nozzle 716 since the spring 404 can then counteract the force of the pressure within rocket 24.

The spring force applied by compression spring 404 will be a function of the appropriate force necessary to maintain the desired predetermined pressure within rocket 24. Preferably, the spring force is calculated to seal the nozzle 716 and the seal 408 up to 80 psi of pressure. In other words, preferably, the spring 404 is designed to release pressure from rocket 24, when the pressure is above 80 psi.

Another feature of the launch platform mechanism 18 is a safety feature in the form of an anti-tilting mechanism. This safety feature permits the rocket to launch if rocket 24 is aimed upwards in a substantially vertical direction, but if the rocket is tilted beyond a predetermined angle from vertical, the launch platform mechanism 18 will prohibit launching of the rocket 24. This feature provides a safety mechanism, in that the rocket 24 cannot be launched horizontally or downwardly, or other potentially dangerous directions.

The safety mechanism comprises four locking pins 418 that are pivoted within pin retainer 416. Each locking pin 418 pivots freely about an axis in response to gravitational forces. In other words, each pin 418 is capable of automatically pivoting about an axis due to gravity in order to self-align into a substantially vertical orientation upon tilting of the launching axis 460 away from the vertical direction. Since the locking pins 418 are spaced around the nozzle 716 any excessive tilting of the rocket 24 in any angle away from being substantially colinear with the vertical axis will result in at least one of the locking pins 418 pivoting from a launching position to a launch-preventing position.

Preferably, pin retainer 416 and locking pins 418 are formed of plastic material. Additionally, locking pins 418 can have a weight 470 formed of metal connected to its lower most portion in order to permit the locking pins 418 to pivot based on the gravitational force of the weight 470 being applied to each locking pin 418.

As seen in FIG. 21, a rocket 24 is positioned substantially vertically. In other words, the launching axis for 460 is colinear with the vertical axis 462. In this position, locking pins 418 are oriented substantially vertically and do not interfere with rocket 24 or engage nozzle 716. Locking pins 418 are also designed so that a certain limited degree of movement of launching axis 460 with respect to vertical axis 462 is permitted. Thus, it is not necessary that the launching axis 460 be perfectly vertical. Although the permitted movement of launching axis 460 is a design choice, preferably, the system is designed to permit launching of rocket 24 if the launching axis 460 is within twenty degrees of the vertical axis 462, in any direction. That is, the rocket 24 could launch if pointed less than twenty degrees from vertical and within a 360-degree circle around the vertical axis 462.

Figure 22:
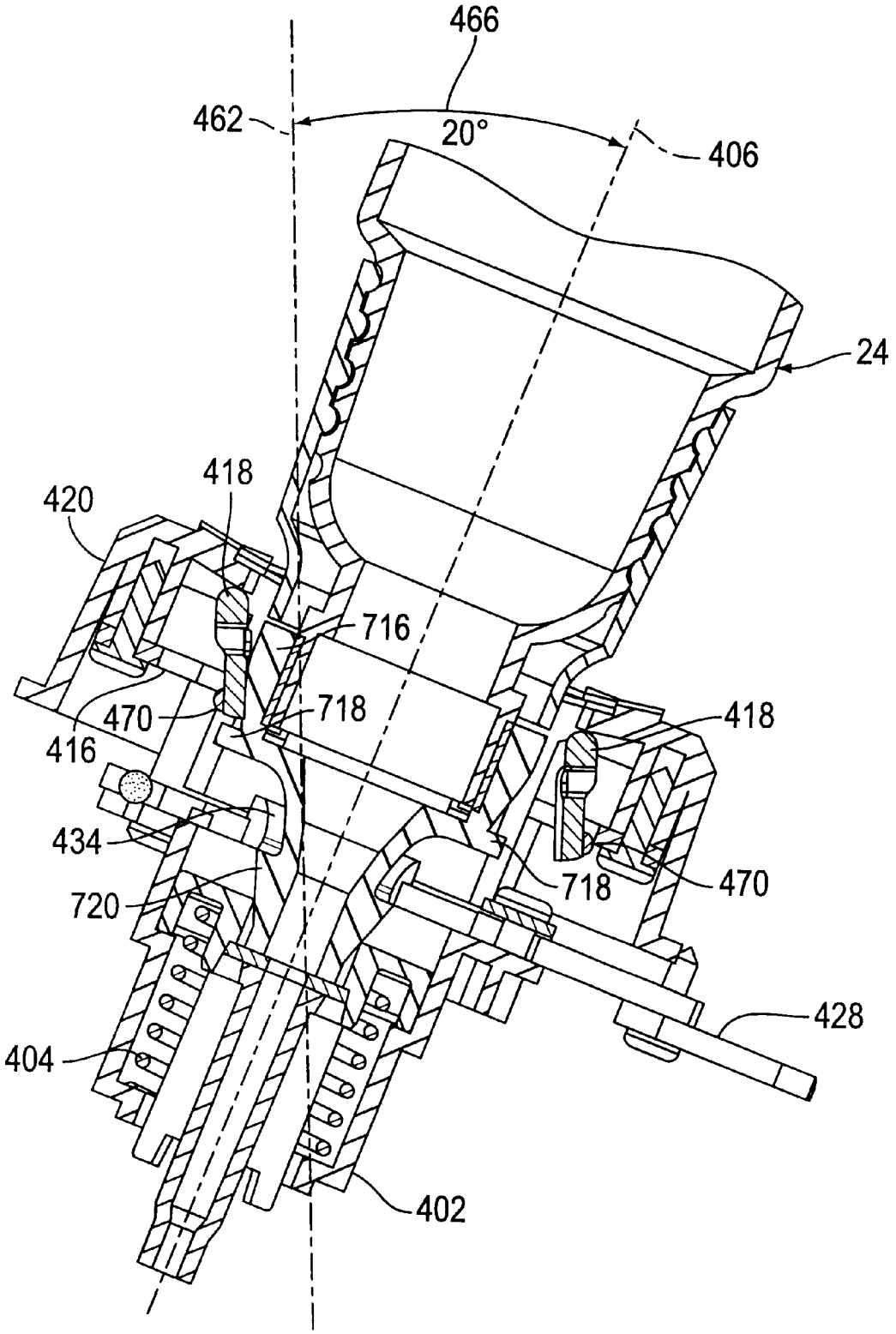
FIG. 22 is a side, cross-sectional view of the rocket and the launch platform mechanism similar to FIG. 22, but illustrating the rocket inclined greater than 20 degrees relative to the vertical axis and illustrating the locking pins engaging the rocket to prohibit launching of the rocket.
Figure 23:
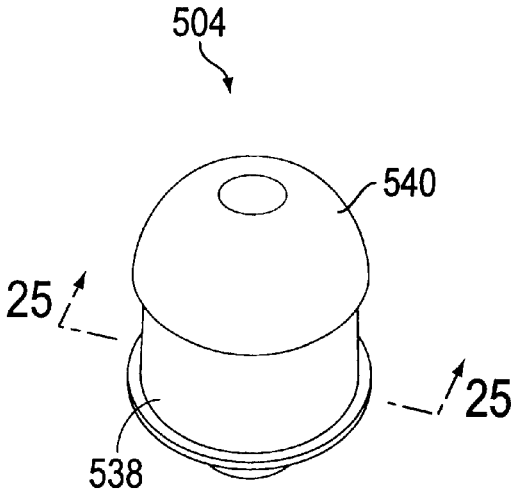
FIG. 23 is a top, front, side perspective view of a trigger safety mechanism in accordance with the present invention.
Figure 24:
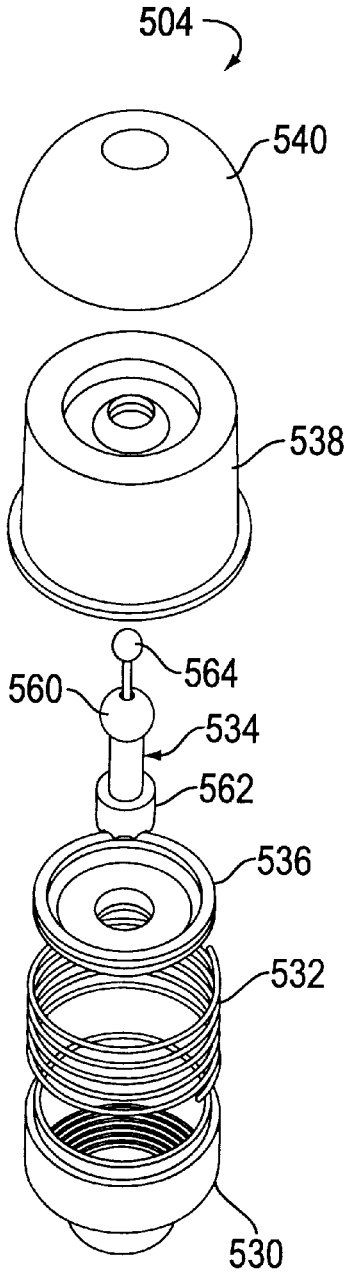
FIG. 24 is an exploded, top, front, side perspective view of the trigger safety mechanism in accordance with the present invention.
Figure 25:
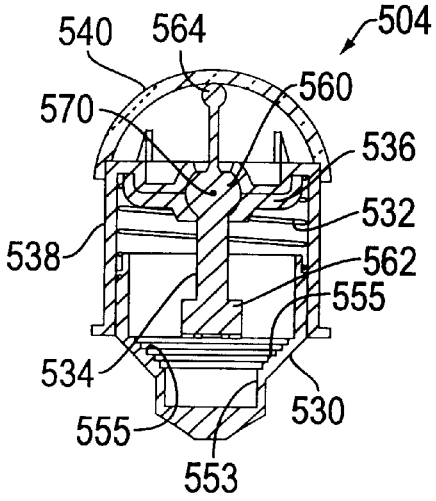
FIG. 25 is a side, cross-sectional view of the trigger safety mechanism in accordance with the present invention taken along line 25—25 in FIG. 23.

However, as illustrated in FIG. 22, if the launching assembly 10 is tilted beyond the predetermined degree such that the rocket 24 and the launching axis 460 is inclined with respect to the vertical axis 462 more than a safe amount, the two locking pins 418 pivot due to the gravitational force. Pins 418 pivot about their own pivot axis, which is perpendicular to the drawing illustrated in FIG. 22. Thus, the locking pins 418 illustrated in FIG. 22 pivot counterclockwise due to gravitational forces. The left locking pin 418 in FIG. 22 has pivoted to contact nozzle 716. In this position, if launching of rocket 24 is attempted, the bottom of locking pin 418 will contact the flange 718 of nozzle 716 and prohibit the rocket 24 from leaving the launch platform mechanism 18. Although the engagement of locking pin 418 illustrated in FIG. 22 shows only one locking pin engaging rocket 24 it should be understood that depending on the inclination of rocket 24 and the intended launching angle, any of the four locking pins 418 could be engaged with rocket 24. Although four locking pins 418 are disclosed to ensure that the rocket will be unable to launch if pointed in any direction while exceeding the predetermined safety margin, various numbers of locking pins can be used. It is only necessary that the locking pins 418 are sufficiently sensitive to engage rocket 24 in the desired, unsafe launching positions to prohibit launching of rocket 24.

If rocket 24 is oriented again in a substantially vertical position as seen in FIG. 21, the locking pins 418 will again rotate to a launch-permitting position. Thus, if the rocket 24 was rotated from the position shown in FIG. 22 to the position shown in FIG. 21, locking pins 418 would rotate in a clockwise direction to the positions illustrated in FIG. 21.

Although the locking pins and nozzle 216 can be arranged to prohibit launching of the rocket 24 at any desired, predetermined angle from the vertical position, preferably, the locking pins engage nozzle 716 at an inclination of the launching axis 460 greater than 20 degrees from the vertical axis 462. Preferably, the engagement at a tilting of greater than the predetermined angle will occur in any direction. The predetermined angle 466 is illustrated in FIG. 22.

As illustrated in FIGS. 23–28, the trigger assembly 20, includes finger-activated trigger 502, a safety mechanism 504 for permitting activation of the trigger only under predetermined conditions and a spring 506 to bias the trigger 502.

Figure 26:
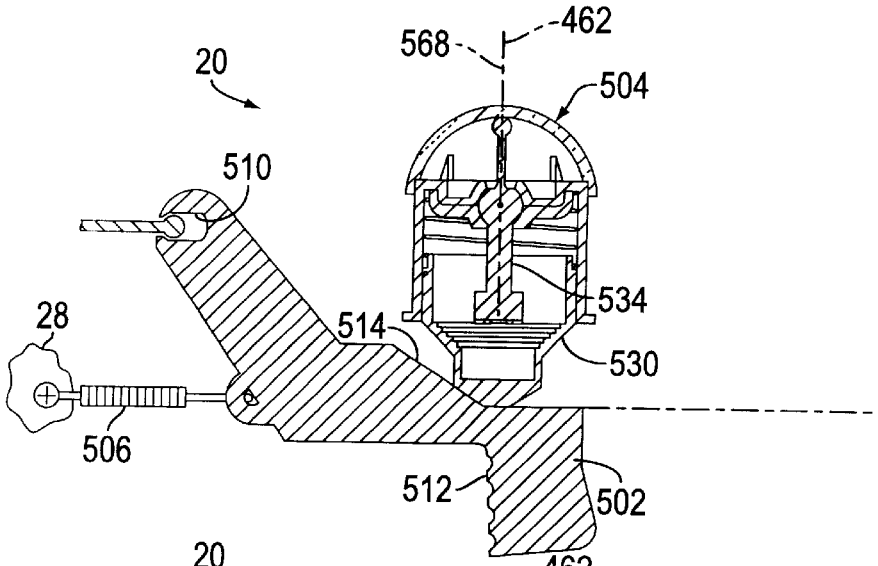
FIG. 26 is a side, cross-sectional view of a trigger assembly in accordance with the present invention illustrating a trigger and the trigger safety mechanism with the trigger being in the at-rest position.

Trigger 502 is preferably formed of plastic material and has a linkage catch 410 for permitting the trigger 502 to move the linkage 414, a finger portion 512, and an incline 514 for engagement with the safety mechanism 504. Trigger 502 is biased in the non-firing position by tension spring 506, which is rigidly secured to housing 28, as seen in FIG. 26. As then seen in FIG. 27, when trigger 502 is moved by a finger of the user towards the firing position and away from rocket 24, the trigger 502 moves against the force of spring 506 and pulls linkage 414 away from rocket 24. The pulling of linkage 414 results in left and right catches 410 and 412 being pivoted about pivot pins 436 and 438 in order to release the rocket 24 as previously discussed.

Figure 27:
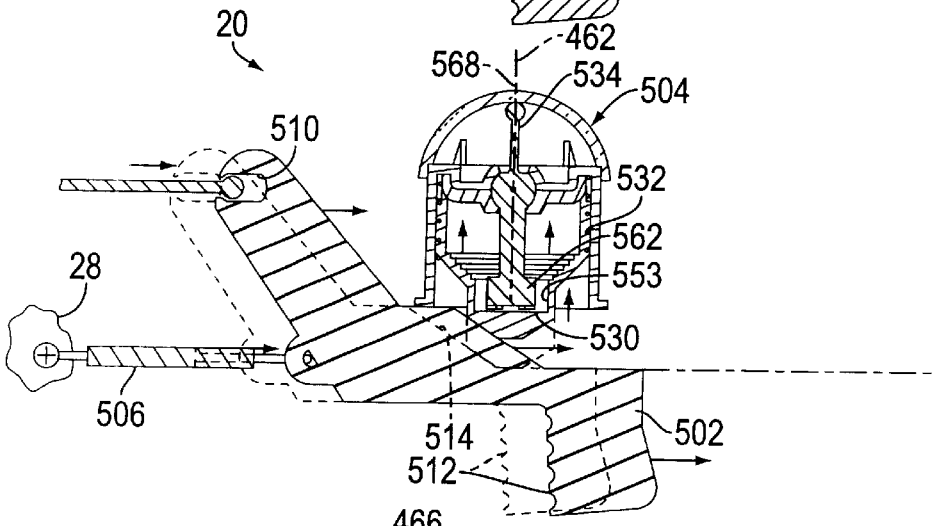
FIG. 27 is a side, cross-sectional view of the trigger assembly in accordance with the present invention and similar to FIG. 26 but showing the trigger in a firing position in solid lines and in the at-rest position in dashed lines, as well as showing the trigger safety mechanism in the launch-permitting position.

If the launching axis and rocket 24 are aligned substantially vertically, or within the acceptable tolerances, trigger 502 is capable of being moved as seen in FIG. 27 in order to pull linkage 414 and release rocket 24 since safety mechanism 508 is properly aligned and permits the firing. However, if launching assembly is tilted greater than the predetermined angle resulting in the firing angle being inclined relative to the vertical axis greater than the predetermined angle, safety mechanism 504 will prohibit trigger 502 from being pulled away from rocket 24 and will prohibit firing of rocket 24. If trigger 502 is not displaced, linkage 414 is not displaced, and, therefore, left and right catches 410 and 412 are not displaced.

Safety mechanism 508 includes a cup 530, a spring 532, a pendulum 534, and a retainer 536 all received within a cover 538 having a window 540. The cup 530 has a cavity 553 and an engagement area 555 for receiving pendulum 534. Additionally, the pendulum 534 has a pivot ball 560, a downwardly extending gripping portion 562 and an indicating portion 564 for viewing through window 540. Pendulum 534 also has a longitudinal, pendulum axis 568.

Figure 28:
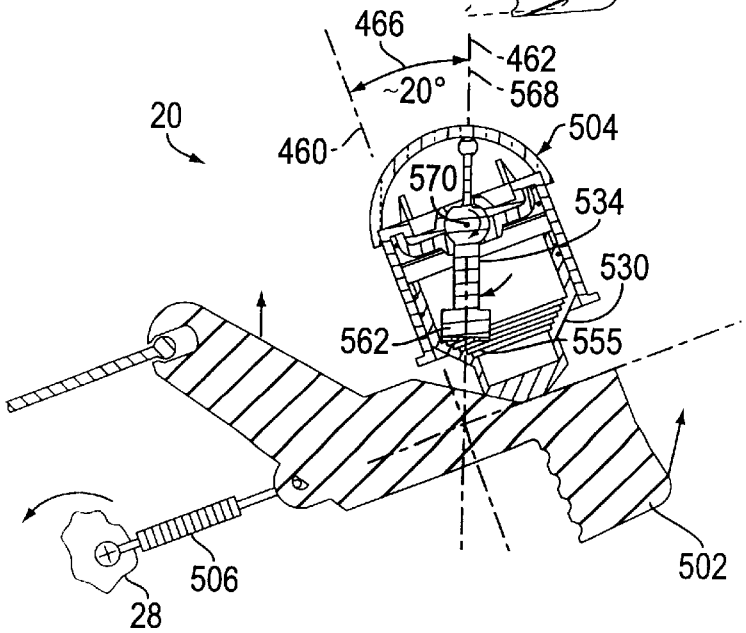
FIG. 28 is a side, cross-sectional view of the trigger assembly in accordance with the present invention similar to FIGS. 26 and 27 but showing the trigger in a non-launching position, the trigger safety mechanism in a launch-prohibiting position, and the launching assembly inclined such that the launch angle is greater than 20 degrees from the vertical axis.
Figure 29:
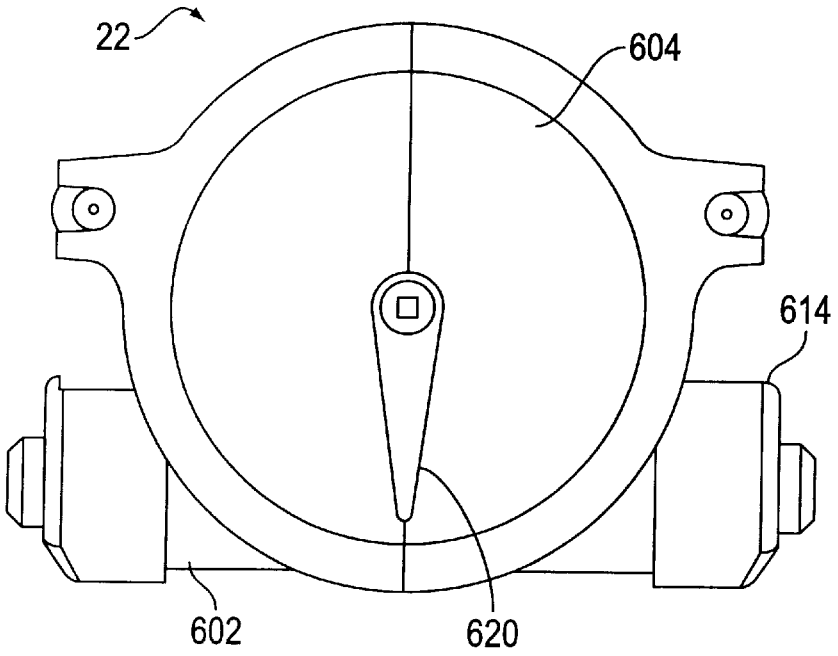
FIG. 29 is a front, elevational view of a pressure indicating assembly in accordance with the present invention.
Figure 30:
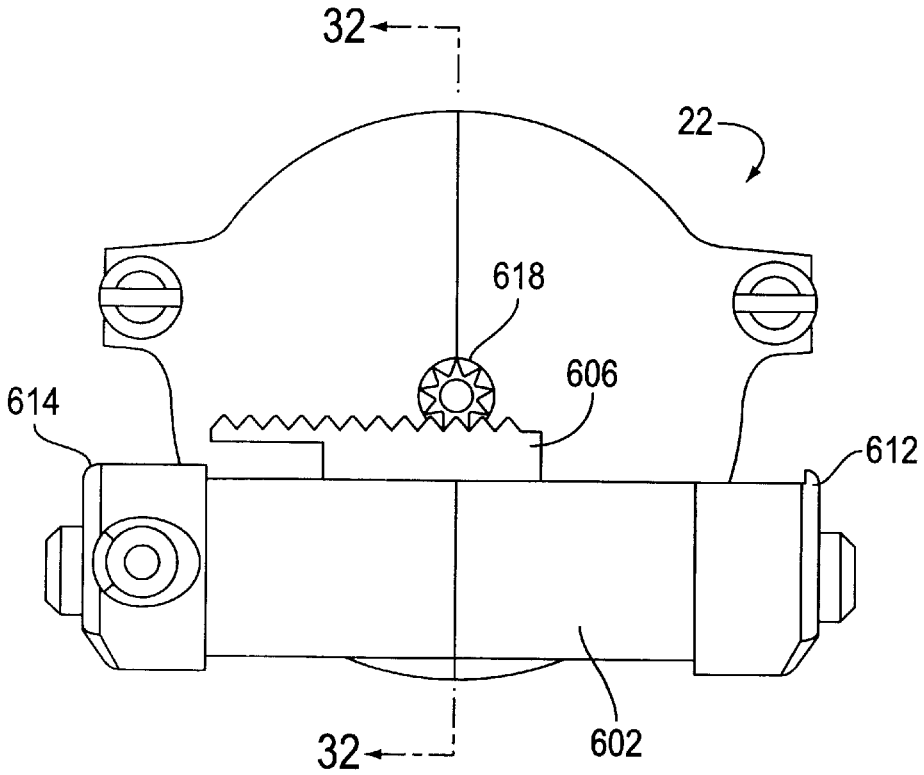
FIG. 30 is a rear, elevational view of the pressure indicating assembly in accordance with the present invention.
Figure 31:
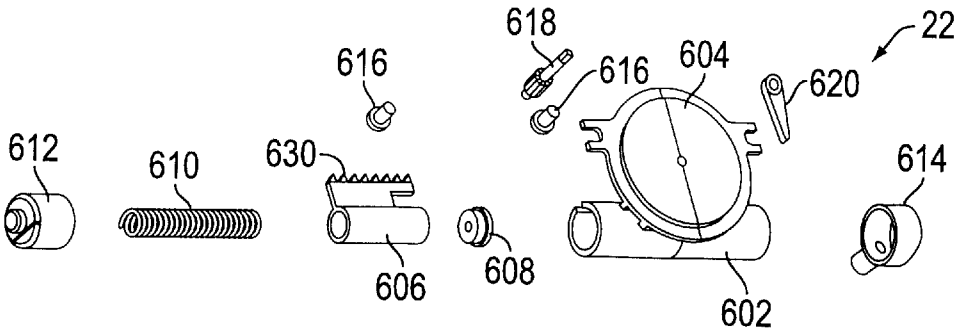
FIG. 31 is a exploded, front, bottom, side perspective view of the pressure indicating assembly in accordance with the present invention.
Figure 33:
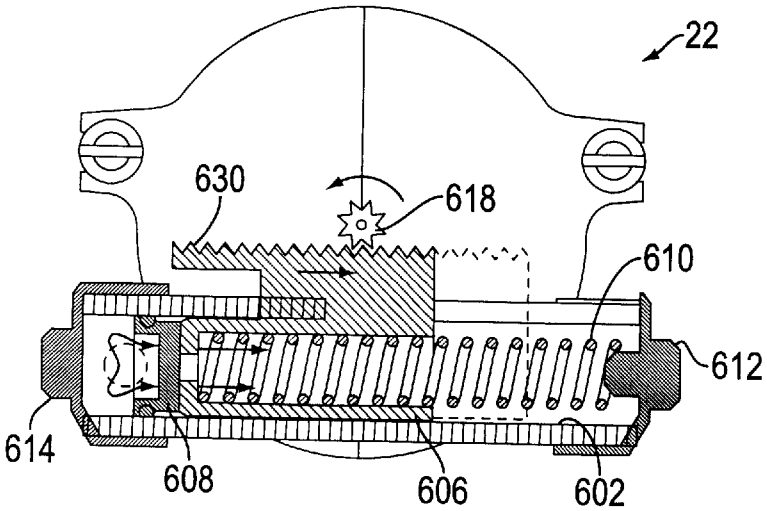
FIG. 33 is a rear, cross-sectional view of the pressure indicating assembly in accordance with the present invention taken along line 33—33 in FIG. 32.
Figure 32:
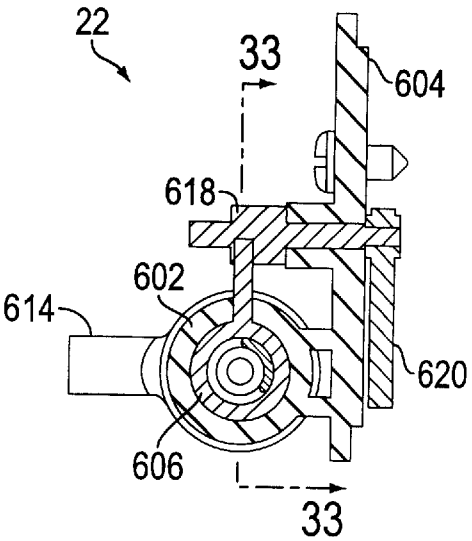
FIG. 32 is a side, cross-sectional view of the pressure indicating assembly in accordance with the present invention taken along line 32—32 in FIG. 30.

As seen in FIG. 28, the pivot ball 560 is held between the cup 530 and the retainer 536 in a central location which permits the pendulum 534 to pivot such that the gripping portion 562 can move about the vertical axis 462 within a 360-degree circle to an inclination relative to the vertical axis 462 greater than the predetermined angle. Pendulum 534 is similar to locking pins 418 in that it is weighted by gripping portion 562 in such that it pivots due to gravitational forces as launching mechanism is inclined. Pendulum 534 pivots freely about a pivot point 570 in response to gravitational forces. In other words, pendulum 534 is capable of automatically pivoting about pivot point 570 due to gravity in order to self-align into a substantially vertical orientation upon tilting of the launching axis 460 away from the vertical direction. This action of pendulum 534 can be aided by the placement of a metal weight on gripping portion 562.

As seen in FIG. 26, when the launching axis 460 is substantially vertical or colinear with the vertical axis 462, the pendulum axis 568 will be substantially vertical. Therefore, as seen in FIG. 27, when the trigger 502 is pulled the incline 514 engages the bottom of cup 530 and forces cup 530 upwards into cover 538. The cavity 553 of cup 530 is sized to receive the gripping portion 562 and does so when the pendulum axis 568 is within the predetermined angular orientation relative to the vertical axis 462. Preferably, the gripping portion 562 is received by cavity 553 if the pendulum angle is inclined within twenty degrees from the vertical axis 462. Under such conditions, the cup 530 can be pushed upwardly a sufficient distance to permit the trigger to move rearwardly a sufficient distance to move the linkage as required to fire the rocket 24.

However, as seen in FIG. 28, if the launching assembly is tilted greater than the predetermined angle and the pendulum axis 568 is inclined relative to the vertical axis 462 greater than the predetermined angle, the pendulum will not enter the cavity 553. The pendulum 534 will pivot as required by gravity and the gripping portion 562 will engage the engagement area 555 and prohibit cup 530 from moving upwardly into cover 538. This limited movement of cup 530 upwardly prohibits the rearward movement of trigger 502 and prevents trigger 502 from being moved sufficiently rearwardly to displace the linkage 414 and fire the rocket 24.

If safety mechanism 504 prohibits the movement of trigger 502 sufficient to fire rocket 24, the launching assembly can be then tilted to the proper launching position until the launching axis 460 is within the predetermined range, such that the trigger 502 can be moved rearwardly as seen in FIG. 27.

When pressure is released from the trigger, the tension spring 506 acts to move the trigger back to the at-rest position as seen in FIG. 26.

Therefore, the launch-preventing mechanisms using the pins 418 and the pendulum 534 provide redundant safety features that are coordinated, through gravitational forces, to act simultaneously. Additionally, since two safety mechanisms are employed, if one of the safety mechanisms should fail, the other safety mechanism will prevent the rocket 24 from firing.

The indicating portion 564 of pendulum 534 protrudes from pivot ball 560 and can be seen through window 540. Therefore, the indicating portion 564 permits a user of the launching assembly to determine whether or not the launching assembly 10 is properly orientated in that the launching axis 460 is sufficiently vertical. Additionally, a small circle can be placed at the top of window 540 in order to indicate the range in which the indicating portion 564 can be positioned while still firing the rocket 24.

As seen in FIGS. 29–33, a pressure indicating assembly 22 indicates to the user the pressure level reached in the rocket 24 and permits the user to selectively vary the pressure to the desired level. If a higher pressure than indicated is desired, the user can continue to pump the pumping mechanism 14 to increase the pressure within rocket 24. Of course, the pressure relief mechanisms in the water storage container 12 and the launch platform 18 will prevent over pressurization beyond a desired limit, as discussed above.

The pressure indicating assembly 22 includes a cylinder 602, a face 604, a piston 606 and rubber stop 608, a spring 610, a cap 612, a cap nozzle 614, a screw 616, a gear 618, a needle 620, a window 622, and a cover 624.

As pressure enters cylinder 602 it forces piston 602 inwardly towards the opposite end of cylinder 602. Since piston 602 has teeth 630 that engage gear 618, as piston 602 moves gear 618 rotates. Needle 620 is attached to gear 618 and moves with gear 618 to provide an indication through window 622 of the pressure level within cylinder 602. The spring 610 and the needle 620 are calibrated to illustrate an accurate pressure reading. Since the cylinder 602 is in fluid communication with the rocket 24, the pressure indicated by gauge 22 is that within the rocket 24.

Figure 35:
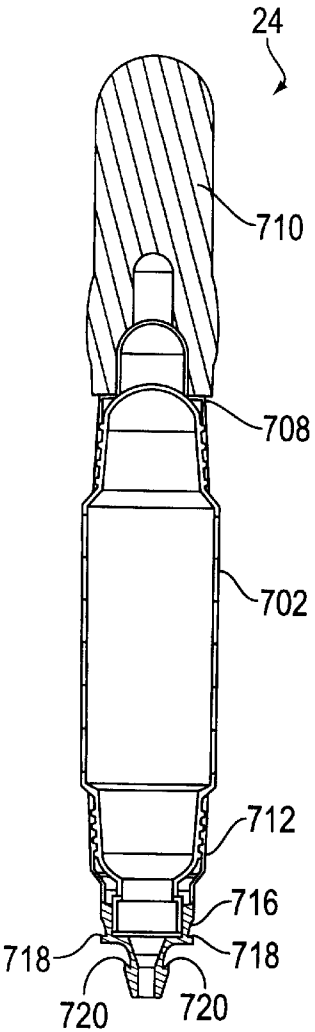
FIG. 35 is a side ,cross-sectional view of the rocket in accordance with the present invention taken along line 35—35 in FIG. 34.
Figure 34:
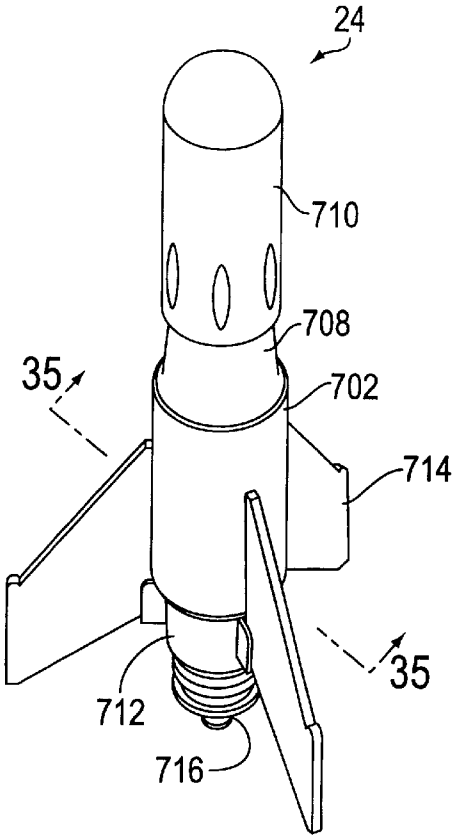
FIG. 34 is a top, front, side perspective view of the projectile or rocket in accordance with the present invention.
Figure 36:
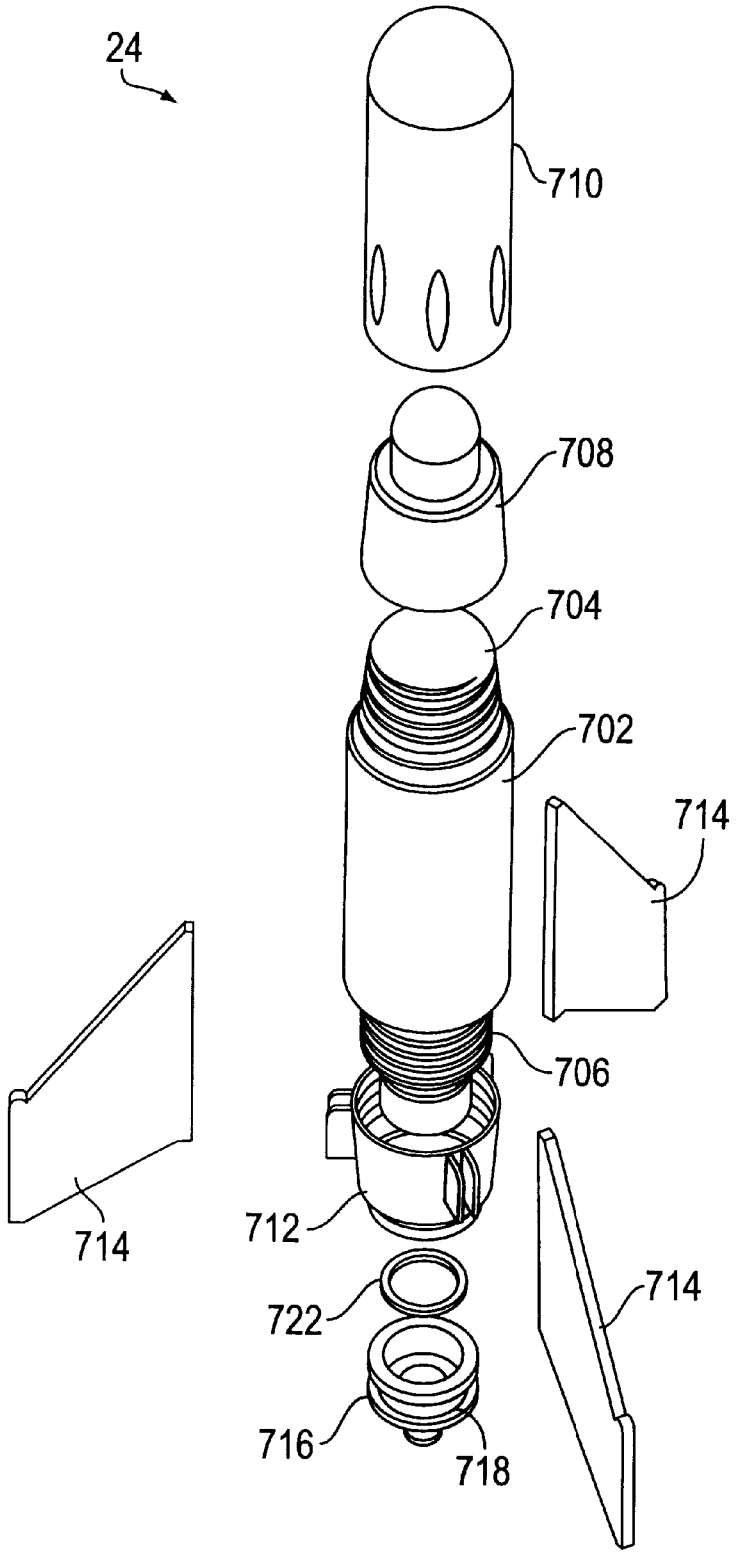
FIG. 36 is an exploded, top, front, side perspective view of the rocket in accordance with the present invention.

As seen in FIGS. 34–36, the projectile or rocket 24 includes a bottle 702 forming the main pressure chamber. The bottle 702 has an upper threaded portion 704 and a lower threaded portion 706 for coupling the bottle 702 with the other elements of rocket 24. An top cap adapter 708 is threaded onto the upper threaded portion 704 and has a nose cap 710 preferably formed of foam material attached thereto for providing a cushioned impact of rocket 24 when it returns to Earth. Cushioned nose cap 710 also provides an added safety feature in that rocket 24 is less dangerous to those below, during its descent.

A fin housing 712 is attached to the lower portion of bottle 702 to support and attach fins 714 around the perimeter of bottle 702. Fins 714 provide stability during flight and are also preferably formed of foam material. Nozzle 716 is threaded to the lower threaded portion of bottle 702 and forms the engagement area with the launch platform 18. Nozzle has a first securing element or flange 17 and a second securing element of ridge 720. Flange 718 extends outwardly a predetermined distance to engage locking pins 418 as necessary when installed within launch platform 18, as discussed above. Ridge 720 is positioned and sized to engage gripping portions 432 and 434 in order to maintain the rocket 24 in a ridged position with launch platform 18, as discussed above.

Rocket 24 is preferably formed of plastic material with nose cap 710 being formed of a foam material. Although the bottle 702 can be formed of any appropriate material, preferably the bottle 702 is blow molded from a PET plastic and shaped appropriately for aerodynamics and weight distribution. The cap adapter 708, fin housing 712 and nozzle 716 are preferably formed from rigid plastic material.

Figure 37:
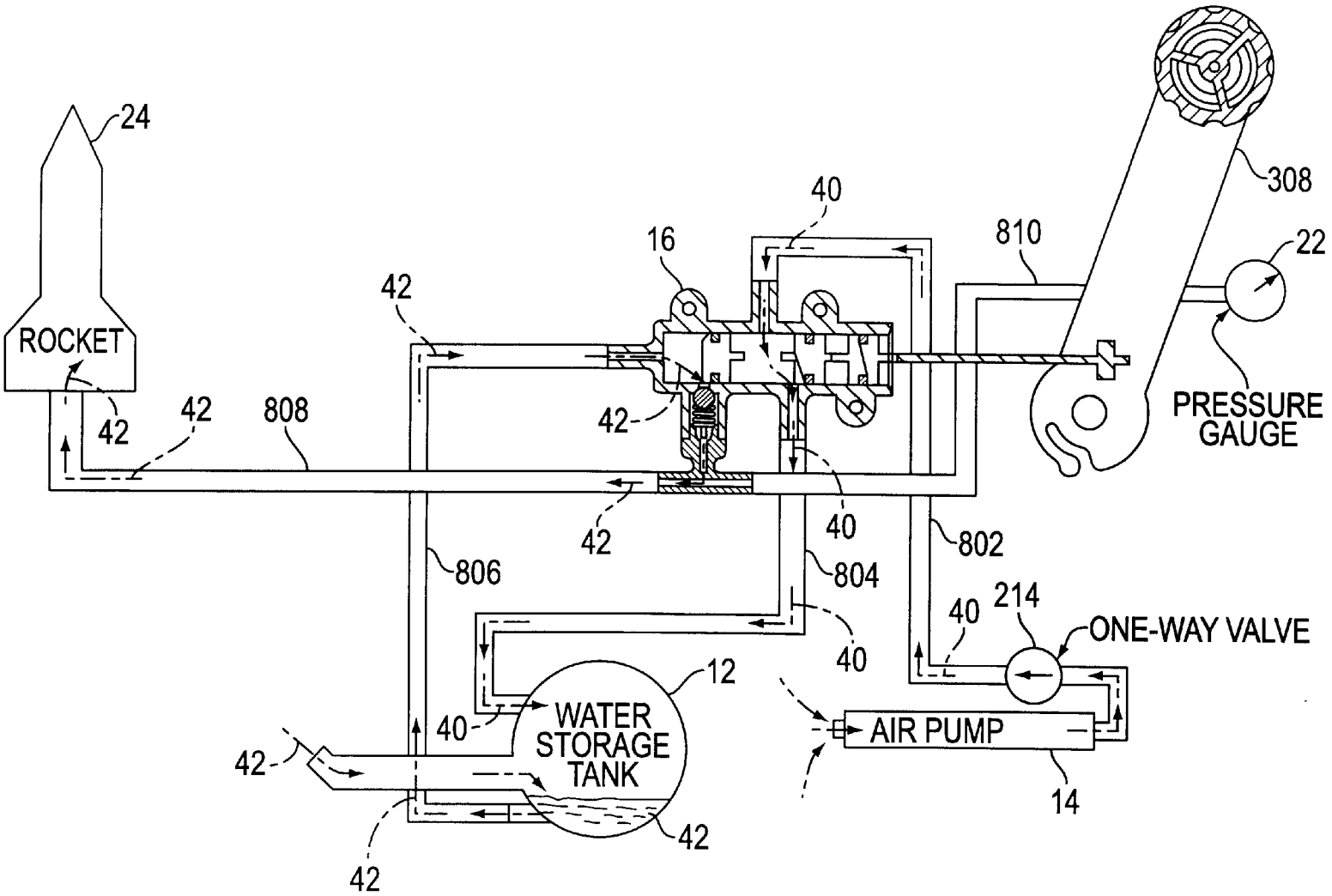
FIG. 37 is a schematic drawing of a fluid system of the launching assembly in accordance with the present invention for loading the rocket with water from the water storage tank.
Figure 38:
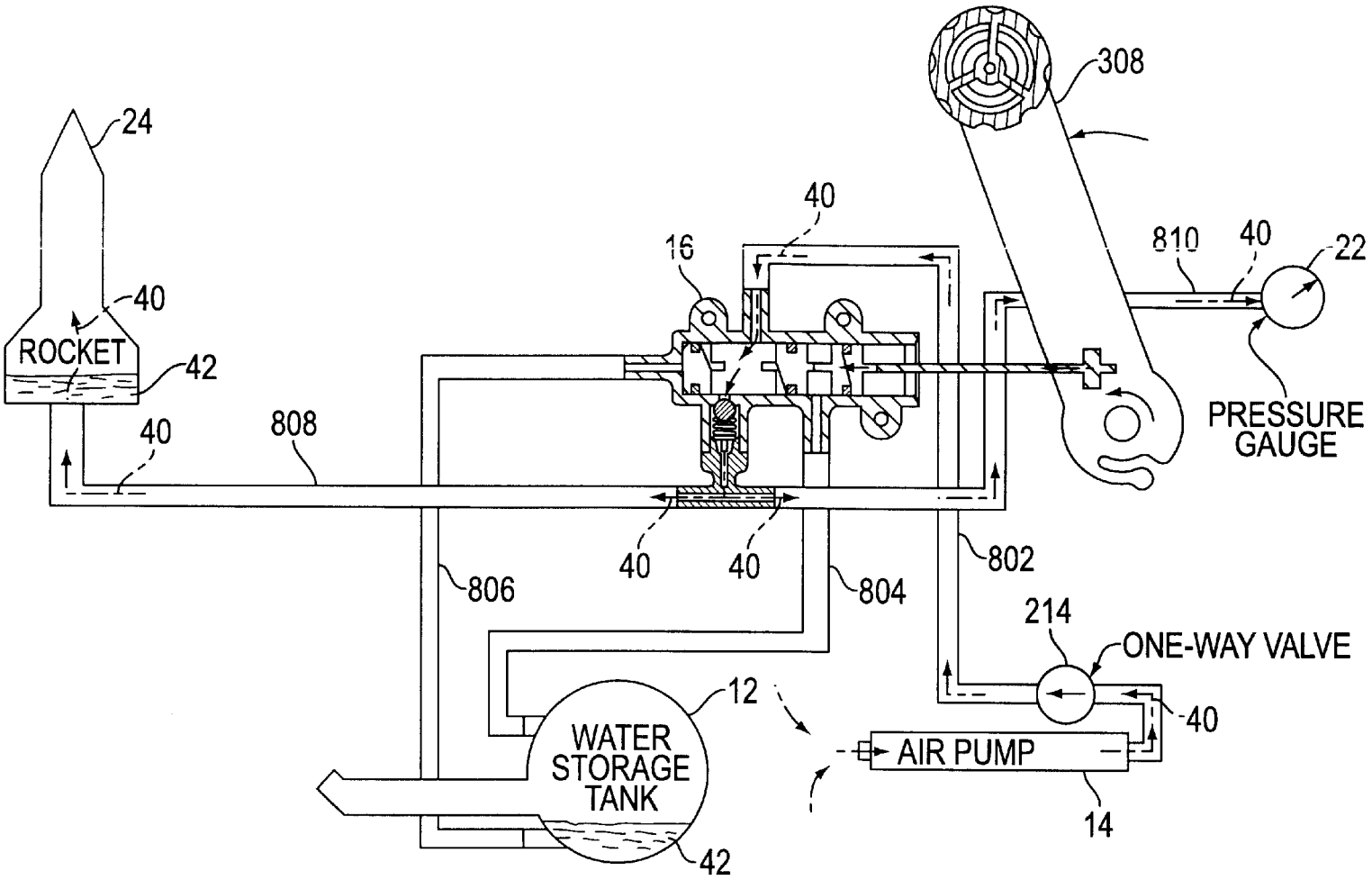
FIG. 38 is a schematic drawing of the fluid system of the launching assembly in accordance with the present invention and similar to FIG. 37, but illustrating the fluid system in a position for loading the rocket with pressurized air from the air pump.

FIGS. 37 and 38 illustrate the preferred manner of pressurization of rocket 24. Water 42 is inserted into water storage tank 12 by removing cap 114 and pouring water 42 into bottle 102. Cap 114 is then tightly secured back into place. The rocket 24 is preferably held by two hands; one hand holding the handle 912 of housing 28 while the second hand holds the handles 205 of pumping mechanism 14. The air pump 14 is then pumped a number of times to increase air pressure with the assembly 10. The air pressure 40 is directed through one-way valve 214 to first conduit 802. The pressurized air 40 then proceeds into valve assembly 16.

The levers 306 and 308 of valve assembly 16 are originally positioned in the water loading position or positioned rearwardly, away from the rocket 24 as seen in FIG. 37. In the water loading position, the pressurized air 40 will pass from conduit 802 through housing 302 to second conduit 804 which leads to water storage tank 12. The pressurized air 40 then pressurizes water storage tank 12 and forces water 42 from water storage tank 12 to valve assembly 16. The water 42 passes through the check valve 314 and proceeds through third conduit 806 to rocket 24 and enters bottle 702. Once a sufficient quantity of water 42 has entered rocket 24 as measured by indicia positioned on the side of the bottle 702, the levers 306 and 308 are pushed forward to change the position of piston 304.

Now, referring to FIG. 38, the pumping mechanism 14 is again pumped to create pressurized air 42 in first conduit 802, which proceeds to valve assembly 16. Do to the new position of piston 304, the pressurized air 40 proceeds through valve assembly 16 into fourth conduit 808 and into bottle 102 of rocket 24. The pumping continues until the appropriate air pressure has been established within rocket 24. The appropriate pressure can be monitored by viewing pressure gage 22, since it is experience the same pressure within bottle 102 through conduits 808 and 810. Once the appropriate pressure within bottle 702 has been released, the trigger 502 is pulled.

If the launching assembly is not properly positioned and the launching axis 460 is not within the permitted range relative to the vertical axis 462, rocket 24 will not be permitted to launch from launching assembly 10. The safety mechanisms in the launch platform 18 and the trigger assembly 20 will prohibit launching. However, if the launching axis 460 is within the correct parameters, the safety mechanisms will not engage, trigger 502 will be permitted to move its full distance, and rocket 24 will launch platform 18, under its own pressure.

Since the water storage tank 12 contains sufficient water for multiple launches by rocket 24, the rocket 24 can then be retrieved and reinserted into launch platform 18. The process can then be repeated multiple times. Of course, any number of rockets 24 or other projectiles can be used instead of reusing the same rocket 24. This process can be repeated until all of the water 42 in water storage tank 12 has been used.

Although this invention has been described with respect to a rocket 24 as the projectile, it should be understood that this invention can be adapted for any type of projectile, especially toy projectiles; such as, automobiles, planes or animals. Additionally, the inventions can be adapted for any type of launching system. For instance, the launching system can be adapted for a horizontal launching system, for example, for launching a toy automobile with the safety mechanisms designed to prohibit launching of the vehicle in a vertical direction.

While advantageous embodiments have been chosen to illustrate the invention, it will be understood by those skilled in the art that various changes and modifications can be made therein without departing from the scope of the invention as defined in the appended claims.

What is claimed is:

1. A toy projectile launching assembly, comprising:

a fluid storage assembly including a storage tank;

a pumping mechanism including a pump;

a projectile;

a valve assembly in fluid communication with said storage assembly, said pumping mechanism, and said projectile, said valve assembly including a valve having a first position in which said storage assembly, said pumping mechanism, and said projectile being in fluid communication and a second position in which said pumping mechanism and said projectile being in fluid communication;

a launch platform assembly including a catch removably coupled to said projectile and a trigger coupled to said catch; and a first launch-prohibiting assembly coupled to said trigger and including a trigger lock movable between a trigger-stopping position and a trigger firing position.

2. A launching assembly according to claim 1, wherein said storage tank contains water, and said pump contains air.

3. A launching assembly according to claim 1, further comprising:

a pressure indicating assembly including a gauge fluidly coupled to said valve assembly, said pumping mechanism, and said projectile.

4. A toy projectile launching assembly, comprising:

a fluid storage assembly including a storage tank containing water;

a pumping mechanism including an air pump;

a projectile having a water and air chamber;

a valve assembly in fluid communication with said storage assembly, said pumping mechanism, and said projectile, said valve assembly including a valve having a first position in which said storage assembly, said pumping mechanism, and said projectile being in fluid communication and a second position in which said pumping mechanism and said water and air chamber being in fluid communication;

a launch platform assembly including a catch removably coupled to said projectile and a trigger coupled to said catch;

a pressure indicating assembly including a gauge fluidly coupled to said valve assembly, said pumping mechanism, and said projectile; and a first launch-prohibiting mechanism coupled to said trigger and including a trigger lock movable between a trigger-stopping position and a trigger firing position, said launch platform assembly having a second launch-prohibiting mechanism including a retaining element movable between a first position in which said retaining element engages said projectile and a second position in which said retaining element does not engage said projectile.

5. A method of launching a toy projectile, comprising the steps of:

providing a launching assembly having a fluid storage assembly including a storage tank for receiving a first fluid, a pumping mechanism including a pump for pumping a second fluid, a projectile, a valve assembly in fluid communication with said storage assembly, said pumping mechanism, and said projectile, said valve assembly including a valve having a first position in which said storage assembly, said pumping mechanism, and said projectile being in fluid communication and a second position in which said pumping mechanism and said projectile being in fluid communication, and a launch platform assembly including a catch removably coupled to said projectile and a trigger coupled to said catch;

positioning said valve to said first position;

actuating said pump to force said second fluid into said storage tank and to, in turn, force said first fluid into said projectile;

repositioning said valve to said second position;

actuating said pump to force said second fluid into said projectile;

moving said trigger to disengage said catch from said projectile and permit said projectile to launch; and filling said storage tank with said first fluid prior to the step of actuating said pump to force said first fluid into said storage tank.

6. A method of launching a projectile according to claim 5, further comprising the step of:

repositioning said projectile on said launch platform and permitting said catch to reengage said projectile;

repositioning said valve from said second position to said first position to permit additional quantities of said first fluid to enter said projectile from said storage tank without adding additional quantities of said first fluid to said storage tank;

repositioning said valve from said first position to said second position to permit additional quantities of said second fluid to enter said projectile;

actuating said pump to force said second fluid into said projectile; and moving said trigger to disengage said catch from said projectile and permit said projectile to launch.

7. A method of launching a projectile according to claim 5, wherein said step of providing a launching assembly includes providing a pressure indicating assembly including a gauge fluidly coupled to said valve assembly, said pumping mechanism, and said projectile, and said step of actuating said pump to force said second fluid into said projectile includes actuating said pump until said gauge indicates a predetermined launch pressure.

8. A method of launching a projectile according to claim 5, wherein said step of providing a launching assembly includes providing a first launch-prohibiting assembly coupled to said trigger and including a trigger lock movable between a trigger-stopping position and a trigger firing position, and aligning said launching assembly to permit said trigger lock to be positioned in a trigger firing position, prior to the step of moving said trigger to disengage said catch from said projectile and permit said projectile to launch.

9. A toy projectile launching assembly, comprising:

a liquid storage assembly including a storage tank having a liquid receiving opening, an intake port, and an output port;

a gas pumping mechanism including a pump having an intake port and an output port; and a projectile having an intake port, said output port of said air pump being coupled by a first conduit and in fluid communication with said intake port of said storage tank, said output port of said storage tank being coupled by a second conduit and in fluid communication with said intake port of said projectile, and said output port of said air pump being coupled by a third conduit and in fluid communication with said intake port of said projectile.

10. A launching assembly according to claim 9, wherein said third conduit includes a portion of said first and second conduits.

11. A launching assembly according to claim 9, wherein said liquid is water and said gas is air.

12. A launching assembly according to claim 10, further comprising:

a valve assembly coupled to said first and second conduits.

13. A launching assembly according to claim 12, wherein said valve assembly includes a fluid intake port, a gas intake port, a gas output port, and a fluid and gas output port, and said first conduit having a first portion positioned between said fluid output port of said storage tank and said fluid intake port of said valve assembly and a second portion positioned between said fluid and gas output port of said valve assembly and said intake port of said projectile, and said second conduit having a first portion positioned between said output port of said pump and said air intake port of said valve assembly and a second portion positioned between said air output port of said valve assembly and said intake port of said storage tank.

14. A method of launching a toy projectile, comprising the steps of:

providing a launching assembly having a storage tank, a projectile, a pump, and a valve coupled together to form a single, integral assembly with the tank, the projectile and the pump being in fluid communication with the valve;

filling the storage tank with liquid;

transferring liquid from the storage tank into the projectile;

switching the valve from a first position to a second position;

pumping gas into the projectile;

holding the entire assembly in a firing position; and launching the projectile.

15. A method according to claim 14, further comprising the step of:

pumping gas into said storage tank and wherein the step of transferring liquid is accomplished by pressure of the gas.

16. A method according to claim 14, wherein the step of switching the valve includes moving a handle attached to said valve from a first orientation to a second orientation.

17. A method according to claim 16, wherein said step of switching the valve includes moving the handle with one hand while supporting the entire assembly with another hand.

18. A method according to claim 17, wherein said step of pumping gas includes activating the pump with one hand while supporting the entire assembly with another hand.

19. A method of launching a toy projectile, comprising the steps of:

providing a launching assembly having a storage tank, a first projectile and a launch platform forming a single, integral assembly, with the tank, the first projectile and the pump being in fluid communication;

filling the storage tank with the entire amount of a quantity of liquid;

transferring a first portion of the quantity of liquid from the storage tank into the first projectile;

pumping gas into the first projectile;

launching the first projectile;

inserting a second projectile into the launch platform;

transferring a second portion of the quantity of liquid from the storage tank into the second projectile;

pumping gas into the second projectile; and launching the second projectile.

20. A method according to claim 19, further comprising:

inserting a third projectile into the launch platform;

transferring a third portion of the quantity of liquid from the storage tank into the third projectile;

pumping gas into the third projectile; and launching the third projectile.

21. A method according to claim 19, wherein said first and second projectiles are the same projectile.

22. A method according to claim 19, further comprising the step of:

holding the entire assembly in a firing position prior to launching the first projectile.

23. A method according to claim 19, wherein:

the step of filling the storage tank with the entire amount of a quantity of liquid includes filling the storage tank with the entire amount of a quantity of water from a water supply, and after filling the storage tank the assembly is remote from the water supply until after launching the second projectile.

24. A toy projectile launching assembly, comprising:

a liquid storage assembly including a storage tank having a liquid receiving opening, an intake port, and an output port, said liquid receiving port having a cap removably coupled to said receiving port for permitting or denying access to said storage tank, said cap having a pressure relief device fluidly coupled to said storage tank;

a gas pumping mechanism including a pump having an output port; and a projectile having an intake port, said output port of said air pump being coupled by a first conduit and in fluid communication with said intake port of said storage tank, said output port of said storage tank being coupled by a second conduit and in fluid communication with said intake port of said projectile.

25. A launching assembly according to claim 24, wherein said pressure relief device is a valve including a spring and a ball.

26. A launching assembly according to claim 24, wherein said pressure relief device includes a means for relieving pressure within said storage tank when said pressure is above the safe operating pressure of said launching assembly.

27. A launching assembly according to claim 26, wherein said pressure relief device is a valve including a spring.

28. A launching assembly according to claim 24, further comprising:

a valve assembly in fluid communication with said storage assembly, said pumping mechanism, and said projectile, said valve assembly including a valve having a first position in which said storage assembly, said pumping mechanism, and said projectile being in fluid communication and a second position in which said pumping mechanism and said projectile being in fluid communication; and a launch platform assembly including a catch removably coupled to said projectile and a trigger coupled to said catch.

29. A toy projectile launching assembly, comprising:

a projectile having a base; and a launch platform assembly including a catch removably coupled to said base and a trigger assembly coupled to said catch, said catch having a first shoulder, a second shoulder, and a biasing element, each of said first and second shoulders being coupled to said trigger assembly and movable between a locking position and a launching position, said biasing element biasing said first and second shoulders in said locking position.

30. An assembly according to claim 29, wherein each of said first and second shoulders are pivotally coupled to a retainer by first and second pivot axes, respectively, and said first and second shoulders pivot about said first and second pivot axes when moving between said locking and launching positions.

31. An assembly according to claim 30, wherein biasing element is a tension spring.

32. An assembly according to claim 29, wherein each of said first and second shoulders has a gripping portion which is positioned within an indentation in said base of said projectile when said first and second shoulders are in the locking position, and said trigger assembly having a linkage connected to said first and second shoulders and a finger-activated trigger coupled to said linkage.

33. An assembly according to claim 29, further comprising:

a fluid storage assembly including a storage tank;

a pumping mechanism including a pump;

a valve assembly in fluid communication with said storage assembly, said pumping mechanism, and said projectile, said valve assembly including a valve having a first position in which said storage assembly, said pumping mechanism, and said projectile being in fluid communication and a second position in which said pumping mechanism and said projectile being in fluid communication.

34. A toy projectile launching assembly, comprising:

a projectile having a base with a first securing element and a second securing element and a firing axis extending centrally through said base and extending along the initial intended flight path of said projectile as the projectile is positioned to launch from the remainder of said launching assembly; and a launch platform assembly including a catch removably coupled to said first securing element and a trigger assembly coupled to said catch, said catch being movable between a locking position and a launching position, said launch platform assembly further including first and second locking pins removably coupled to said second securing element, each of said first and second locking pins being coupled to a launch platform and being pivotable between an engaged position in contact with said second securing element and a disengaged positioned spaced from said second securing element, at least one of said first and second locking pins being in the engaged position when said firing axis is inclined relative a vertical axis and each of said first and second locking pins being in the disengaged position when said firing axis is parallel to said vertical axis.

35. An assembly according to claim 34, wherein said launch platform assembly further includes a third locking pin removably coupled to said second securing element, said third locking pin being coupled to said launch platform and being pivotable between an engaged position in contact with said second securing element and a disengaged positioned spaced from said second securing element, said third locking pin being in the engaged position when said firing axis is inclined relative said vertical axis and said third locking pin being in the disengaged position when said firing axis is parallel to said vertical axis.

36. An assembly according to claim 35, wherein said launch platform assembly further includes a fourth locking pin removably coupled to said second securing element, said fourth locking pin being coupled to said launch platform and being pivotable between an engaged position in contact with said second securing element and a disengaged positioned spaced from said second securing element, said fourth locking pin being in the engaged position when said firing axis is inclined relative said vertical axis and said fourth locking pin being in the disengaged position when said firing axis is parallel to said vertical axis.

37. An assembly according to claim 34, wherein said second securing element is a single, integral flange extending around said base of said projectile.

38. An assembly according to claim 34, further comprising:

a fluid storage assembly including a storage tank;

a pumping mechanism including a pump;

a valve assembly in fluid communication with said storage assembly, said pumping mechanism, and said projectile, said valve assembly including a valve having a first position in which said storage assembly, said pumping mechanism, and said projectile being in fluid communication and a second position in which said pumping mechanism and said projectile being in fluid communication.

39. A toy projectile launching assembly, comprising:

an air pump;

a projectile having a pressure chamber for receiving air from said pump;

a first conduit coupled to said pump and to said pressure chamber with said pump and said pressure chamber being in fluid communication with each other; and a launch platform positioned between said projectile and said first conduit and coupling said projectile and said first conduit together, said launch platform having a pressure relief device biasing said projectile and said first conduit together.

40. An assembly according to claim 39, wherein said pressure relief device includes a spring and a gasket.

41. An assembly according to claim 40, wherein said spring is a compression spring having a predetermined stiffness corresponding to a predetermined pressure exerted on said spring by pressure in said pressure chamber.

42. An assembly according to claim 39, further comprising:

a fluid storage assembly including a storage tank; and a valve assembly in fluid communication with said storage assembly, said pump, and said projectile, said valve assembly including a valve having a first position in which said storage assembly, said pumping mechanism, and said projectile being in fluid communication and a second position in which said pump and said projectile being in fluid communication.

43. An assembly according to claim 39, wherein said launch platform includes a catch removably coupled to a base of said projectile and a trigger assembly coupled to said catch.

44. A toy projectile launching assembly, comprising:

a projectile having a base; and a launch platform assembly including a catch removably coupled to said base;

a trigger assembly coupled to said catch; and a trigger-locking mechanism connected to said trigger and having a upper housing, a lower housing slidably coupled to said upper housing, and a stop coupled to said upper housing and moveable between a lock position in which said stop engages said lower housing and prohibits movement of said trigger and a fire position in which said stop permits movement of said trigger.

45. An assembly according to claim 44, wherein trigger-locking mechanism includes a biasing element positioned between said upper housing and said lower housing for biasing said lower housing away from said upper housing, and said stop is a pendulum.

46. An assembly according to claim 45, wherein said pendulum is capable of movement in at least four directions and has a pivoting portion and an opposite, first gripping portion for coupling with said lower housing.

47. An assembly according to claim 46, wherein said lower housing has a second gripping portion surrounding a hollow area adapted to receive said first gripping portion.

48. An assembly according to claim 44, further comprising:

a fluid storage assembly including a storage tank;

an air pump; and a valve assembly in fluid communication with said storage assembly, said pump, and said projectile, said valve assembly including a valve having a first position in which said storage assembly, said pumping mechanism, and said projectile being in fluid communication and a second position in which said pump and said projectile being in fluid communication.

49. A toy projectile, comprising:

a storage tank having an upper threaded portion, a lower threaded portion and a middle portion;

cushioning member having a threaded element engaged with said upper threaded portion of said tank; and a nozzle for locking said projectile into a launching platform and for receiving pressurized fluid, said nozzle having a threaded element engaged with said lower threaded portion of said tank.

50. A projectile according to claim 49, wherein said cushioning member includes a foam element coupled to said threaded element.

51. A projectile according to claim 50, wherein said nozzle includes a locking element for coupling the launching platform and an aperture for receiving pressurized fluid.

52. A projectile according to claim 49, wherein said storage tank, said cushioning member, and said nozzle are plastic.

53. A method of launching a toy projectile, comprising the steps of:

providing a launching assembly having a projectile and a launch platform having first and second launch preventing mechanisms;

orienting said launching assembly to a first position to launch said projectile;

prohibiting the launching of said projectile through the engagement of said first launch preventing mechanism;

prohibiting the launching of said projectile through the engagement of said second launch preventing mechanism;

reorienting said launching assembly to a predetermined, second position to launch said projectile; and launching said projectile.

54. A method according to claim 53, wherein the step of prohibiting the launching of said projectile through the engagement of said first launch preventing mechanism and the step of prohibiting the launching of said projectile through the engagement of said second launch preventing mechanism occur simultaneously.

55. A method of launching a toy projectile, comprising the steps of:

providing a launching assembly having a fluid storage assembly including a storage tank for receiving a first fluid, a pumping mechanism including a pump for pumping a second fluid, a projectile, a valve assembly in fluid communication with said storage assembly, said pumping mechanism, and said projectile, said valve assembly including a valve having a first position in which said storage assembly, said pumping mechanism, and said projectile being in fluid communication and a second position in which said pumping mechanism and said projectile being in fluid communication, and a launch platform assembly including a catch removably coupled to said projectile and a trigger coupled to said catch;

positioning said valve to said first position;

actuating said pump to force said second fluid into said storage tank and to, in turn, force said first fluid into said projectile;

repositioning said valve to said second position;

actuating said pump to force said second fluid into said projectile; and moving said trigger to disengage said catch from said projectile and permit said projectile to launch, wherein said step of providing a launching assembly includes providing a pressure indicating assembly including a gauge fluidly coupled to said valve assembly, said pumping mechanism, and said projectile, and said step of actuating said pump to force said second fluid into said projectile includes actuating said pump until said gauge indicates a predetermined launch pressure.

56. A method of launching a projectile according to claim 55, further comprising the step of:

filling said storage tank with said first fluid prior to the step of actuating said pump to force said first fluid into said storage tank.

57. A method of launching a projectile according to claim 56, further comprising the step of:

repositioning said projectile on said launch platform and permitting said catch to reengage said projectile;

repositioning said valve from said second position to said first position to permit additional quantities of said first fluid to enter said projectile from said storage tank without adding additional quantities of said first fluid to said storage tank;

repositioning said valve from said first position to said second position to permit additional quantities of said second fluid to enter said projectile;

actuating said pump to force said second fluid into said projectile; and moving said trigger to disengage said catch from said projectile and permit said projectile to launch.

58. A method of launching a projectile according to claim 55, wherein said step of providing a launching assembly includes providing a first launch-prohibiting assembly coupled to said trigger and including a trigger lock movable between a trigger-stopping position and a trigger firing position, and aligning said launching assembly to permit said trigger lock to be positioned in a trigger firing position, prior to the step of moving said trigger to disengage said catch from said projectile and permit said projectile to launch.

59. A method of launching a toy projectile, comprising the steps of:

providing a launching assembly having a fluid storage assembly including a storage tank for receiving a first fluid, a pumping mechanism including a pump for pumping a second fluid, a projectile, a valve assembly in fluid communication with said storage assembly, said pumping mechanism, and said projectile, said valve assembly including a valve having a first position in which said storage assembly, said pumping mechanism, and said projectile being in fluid communication and a second position in which said pumping mechanism and said projectile being in fluid communication, and a launch platform assembly including a catch removably coupled to said projectile and a trigger coupled to said catch;

positioning said valve to said first position;

actuating said pump to force said second fluid into said storage tank and to, in turn, force said first fluid into said projectile;

repositioning said valve to said second position;

actuating said pump to force said second fluid into said projectile; and moving said trigger to disengage said catch from said projectile and permit said projectile to launch, wherein said step of providing a launching assembly includes providing a first launch-prohibiting assembly coupled to said trigger and including a trigger lock movable between a trigger-stopping position and a trigger firing position, and aligning said launching assembly to permit said trigger lock to be positioned in a trigger firing position, prior to the step of moving said trigger to disengage said catch from said projectile and permit said projectile to launch.

60. A method of launching a projectile according to claim 59, further comprising the step of:

filling said storage tank with said first fluid prior to the step of actuating said pump to force said first fluid into said storage tank.

61. A method of launching a projectile according to claim 60, further comprising the step of:

repositioning said projectile on said launch platform and permitting said catch to reengage said projectile;

repositioning said valve from said second position to said first position to permit additional quantities of said first fluid to enter said projectile from said storage tank without adding additional quantities of said first fluid to said storage tank;

repositioning said valve from said first position to said second position to permit additional quantities of said second fluid to enter said projectile;

actuating said pump to force said second fluid into said projectile; and moving said trigger to disengage said catch from said projectile and permit said projectile to launch.

62. A method of launching a projectile according to claim 59, wherein said step of providing a launching assembly includes providing a pressure indicating assembly including a gauge fluidly coupled to said valve assembly, said pumping mechanism, and said projectile, and said step of actuating said pump to force said second fluid into said projectile includes actuating said pump until said gauge indicates a predetermined launch pressure.

* * * * *